US008561730B2

(12) United States Patent
Yao et al.

(10) Patent No.: US 8,561,730 B2
(45) Date of Patent: Oct. 22, 2013

(54) FOOT VALVE ASSEMBLY FOR A DOWN HOLE DRILL

(75) Inventors: Jing James Yao, Mississauga (CA); Paul Campbell, Troutville, VA (US); William H. Dell, II, Fort Loudon, PA (US); Dale R. Wolfer, Salem, VA (US); Timothy J. Plunkett, Roanoke, VA (US)

(73) Assignee: Atlas Copco Secoroc LLC, Grand Prairie, TX (US)

( * ) Notice: Subject to any disclaimer, the term of this patent is extended or adjusted under 35 U.S.C. 154(b) by 123 days.

(21) Appl. No.: 12/729,828

(22) Filed: Mar. 23, 2010

(65) Prior Publication Data

US 2011/0232922 A1 Sep. 29, 2011

(51) Int. Cl.
*E21B 10/36* (2006.01)

(52) U.S. Cl.
USPC ..... 175/417; 175/297; 173/53; 173/90

(58) Field of Classification Search
USPC ..... 166/386, 319; 175/297, 417; 251/333; 173/53, 90; 285/18, 137.11, 141.1, 285/222, 331; 403/108, 359.5
See application file for complete search history.

(56) References Cited

U.S. PATENT DOCUMENTS

| | | | | |
|---|---|---|---|---|
| 4,084,647 | A | 4/1978 | Lister | |
| 4,146,097 | A | 3/1979 | Curington | |
| 4,821,812 | A | 4/1989 | Ditzig | |
| 5,085,284 | A | 2/1992 | Fu | |
| 5,139,095 | A | 8/1992 | Lyon et al. | |
| 5,143,162 | A | 9/1992 | Lyon et al. | |
| 5,240,083 | A | 8/1993 | Lyon | |
| 5,301,761 | A | 4/1994 | Fu et al. | |
| 5,325,926 | A | 7/1994 | Lay et al. | |
| 5,390,749 | A | 2/1995 | Lyon | |
| 5,562,170 | A | 10/1996 | Wolfer et al. | |
| 5,566,771 | A | 10/1996 | Wolfer et al. | |
| 5,647,447 | A | 7/1997 | Jones | |
| 5,682,957 | A | 11/1997 | Lyon | |
| 5,699,867 | A | 12/1997 | Jones | |
| 5,711,205 | A * | 1/1998 | Wolfer et al. | 92/155 |

(Continued)

FOREIGN PATENT DOCUMENTS

| | | |
|---|---|---|
| EP | 1191241 | 3/2002 |
| GB | 1474501 | 5/1977 |
| WO | 2006/116646 | 11/2006 |

OTHER PUBLICATIONS 06751696.3 extended European search report dated Dec. 23, 2009 (4 pages).

(Continued)

*Primary Examiner* — Yong-Suk (Philip) Ro
(74) *Attorney, Agent, or Firm* — Venable LLP; Eric J. Franklin

(57) ABSTRACT

A retaining assembly for a cylindrical member and support sleeve in the bore of a component of a DTH. The cylindrical member and support sleeve may, for example, be a foot valve assembly for insertion into a counter bore in a bit. The cylindrical member has a cylindrical member rigidity and at least a portion of the support sleeve has a rigidity greater than the cylindrical member rigidity. A gap is provided between the sleeve and the component bore of the DTH. The cylindrical member deforms in the gap, resulting in the cylindrical member being fixedly sandwiched between the support sleeve and the component bore.

29 Claims, 12 Drawing Sheets

(56) References Cited

U.S. PATENT DOCUMENTS

| | | | |
|---|---|---|---|
| 5,735,358 | A | 4/1998 | Lyon |
| 5,794,516 | A | 8/1998 | Wolfer et al. |
| 6,135,216 | A | 10/2000 | Lyon et al. |
| 6,170,581 | B1 | 1/2001 | Lay |
| 6,237,704 | B1 | 5/2001 | Lay |
| 6,799,641 | B1 | 10/2004 | Lyon et al. |
| 7,159,676 | B2 | 1/2007 | Lyon |
| 7,467,675 | B2 | 12/2008 | Lay |
| 7,624,822 | B2 | 12/2009 | Olsson et al. |
| 2004/0108720 | A1 * | 6/2004 | Mallis ..... 285/334 |
| 2009/0308661 | A1 | 12/2009 | Wolfer et al. |

OTHER PUBLICATIONS

PCT/US06/16126 International Search Report dated Sep. 29, 2006 (1 page).

International Search Report and Written Opinion for Application No. PCT/US2011/028838 dated Oct. 27, 2011 (10 pages).

International Preliminary Report on Patentability for Application No. PCT/US2011/028838 dated Jun. 19, 2012 (16 pages).

* cited by examiner

FOOT VALVE ASSEMBLY FOR A DOWN HOLE DRILL

BACKGROUND

The present invention relates to a method and apparatus for affixing a cylindrical member in a down-the-hole drill or hammer, often referred to in the industry as a DTH drill. In a one exemplary embodiment, the present invention relates to a method and apparatus for affixing a foot valve assembly in a DTH drill.

FIGS. 1A and 1B illustrate a known percussive drill assembly 1 or DTH drill. FIGS. 1A and 1B are taken, with some edits to the reference numerals for the purposes of this description, from U.S. patent application Ser. No. 12/366,014 filed Feb. 5, 2009, the entire contents of which are incorporated by reference into the present application. These prior art figures are provided to illustrate one assembly of a known DTH drill. There are many variations on assemblies of DTH drill but FIGS. 1A and 1B illustrate some of the basic components for background purposes.

With reference to FIGS. 1A and 1B, the known DTH drill 1 includes a casing 2 with lower and upper ends 2*a*, 2*b*, and a top sub 3 interconnected with the upper end 2*b* of the casing 2. The casing 2 includes a central bore 4, a central axis $A_C$ extending through the bore 4 between the two ends 2*a*, 2*b*, and a fluid supply chamber 5 defined within the bore 4. A source of motive fluid connects to the top sub 3 for the supply of motive fluid to the fluid supply chamber 5. The DTH drill also includes a bit 6 at the lower end 2*a* of the casing 2, and a shank 6' that extends up into the casing 2. In other embodiments, the bit 6 and shank 6' are formed integrally with each other, and throughout this specification, the term "bit" is intended to include the bit 6 and shank 6' whether or not the two parts are formed integrally or separately. The bit 6 includes an upper end 6*a*, a lower end 6*b*, and a bit bore 6*c* extending from the lower end 6*b* through the bit 6 along the central axis Ac.

FIG. 1C further illustrates a representative lower portion of a prior art DTH drill, including more details of a representative bit 6. The bit bore 6*c* has a bit bore diameter 6*d*. A counter bore 6*e* is formed in the upper end 6*a* of the bit 6 coaxially with the bit bore 6*c* (i.e., both the bit bore 6*c* and the counter bore 6*e* are centered on the central axis Ac), and has a counter bore diameter 6*f* larger than the bit bore diameter 6*d*. The bottom of the counter bore 6*e* defines a ring-shaped shoulder 6*g* extending from the counter bore wall 6*e* to the top of the bit bore 6*c*. The counter bore 6*e* includes cavities 6*h* in the counter bore wall 6*e*. The cavities 6*h* can be a continuous slot extending around the circumference of the counter bore wall 6*e* or may include one or more discrete, unconnected cavities spaced around the circumference. In some embodiments of the prior art, the counter bore 6*e* is cylindrical with side walls parallel to the central axis Ac. In other prior art embodiments, the counter bore 6*e* has tapered walls that are not parallel to the central axis Ac such that the counter bore 6*e* widens or narrows from the upper end 6*a* to the bottom of the counter bore 6*g*. Although embodiments of the present invention are described and illustrated with counter bores 6*e* that are cylindrical, the present invention can be applied to all types of counter bores 6*e*.

Referring again to FIGS. 1A and 1B, a piston 7 is movably disposed within the casing bore 4. The piston 7 includes an upper end 7*a*, a lower end 7*b*, and a piston bore 7*c* extending through the piston 7 between the upper end 7*a* and the lower end 7*b*. A valve member 8 is movably disposed within the casing bore 4 generally between the piston 7 and the casing upper end 2*b*. A distributor cylinder 10 is disposed within the casing bore 4 and receives the valve member 8 in an upper end 10*a*, and receives the upper end 7*a* of the piston 7 in a lower end 10*b*. The valve member 8 and distributor cylinder 10 together regulate and direct the flow of motive fluid from the supply chamber 5 to a drive chamber 12*a* above the piston 7 and a return chamber 12*b* below the piston 7. The cyclical provision of motive fluid to the drive and return chambers 12*a*, 12*b* causes the piston 7 to rise and lower within the casing bore 4. The cyclical up and down motion of the piston 7 causes the bottom end 7*b* of the piston 7 to cyclically strike the upper end 6*a* of the bit 6 to drive the drilling operation of the bit 6.

An exhaust tube 14 is mounted within the counter bore 6*e* and extends out the upper end 6*a* of the bit 6 into the return chamber 12*b*. As the piston 7 approaches the lower position (FIG. 1A), the exhaust tube 14 extends into the piston bore 7*c*, which cuts off communication between the bit bore 6*c* and the return chamber 12*b* through the exhaust tube 14. As the piston 7 approaches the raised position (FIG. 1B), the exhaust tube 14 is removed from the piston bore 7*c* and communication between the bit bore 6*c* and the return chamber 12*b* is established through the exhaust tube 14.

Referring once again to FIG. 1C, the exhaust tube 14 is inserted into the counter bore 6*e*. In the illustrated construction, the exhaust tube 14 is a relatively simple plastic tube that includes humps 14*a* on the outer surface of its lower portion. In some embodiments, the humps 14*a* can extend all the way around the tube 14 like a ridge, and in other embodiments the humps 14*a* could be one or more bulges in the side of the tube 14, corresponding to one or more of the cavities 6*h* discussed above with respect to the counter bore 6*e*. The exhaust tube 14 is inserted into the counter bore 6*e* until the distal end of the exhaust tube 14 abuts the shoulder 6*g* at the bottom of the counter bore 6*e*. When the exhaust tube 14 is so inserted, the humps 14*a* align with and are received within the cavities 6*h*. Although in the illustrated embodiment the humps 14*a* do not extend to the back of the cavities 6*h*, in other embodiments the humps 14*a* do extend to the backs of the cavities 6*h* and the interaction between the humps 14*a* and the cavities 6*h* gives rise to a large portion of the interference load. In other embodiments, there may not be cavities 6*h*, but the tube may include the humps 14*a* which bear directly against a wall of the bit bore 6*c* or counter bore 6*e* and the assembly may rely substantially entirely on the frictional interface between the humps 14*a* and the side wall of the bit bore 6*c* or counter bore 6*e* for the interference fit. The exhaust tube 14 in a DTH drill bit provides a vital function for the drill to operate continuously. In early days of DTH drill design, aluminum tubes were used. Due to the high material cost and complicacy of installation, aluminum tubes were replaced by plastic tubes in the 1980's. One popular plastic material for such tubes is Delrin® plastic. Delrin® is a registered trademark of E. I. Du Pont de Nemours and Company.

The exhaust tube 14 is held in the bit counter bore 6*e* by way of an interference fit and also by virtue of the interaction of the humps 14*a* and cavities 6*h*. The undeformed original outer diameter of the exhaust tube 14 is slightly larger than the diameter 6*f* of the counter bore 6*e*. The exhaust tube 14 is forced into the counter bore 6*e*, which causes the exhaust tube 14 to deform. The shape memory of the plastic material in the exhaust tube 14 causes the exhaust tube 14 to expand against the wall of the counter bore 6*e*. This gives rise to a gripping force between the exhaust tube 14 and the wall of the counter bore 6*e*. The gripping force is a function of (e.g., proportional to) the pressure exerted by the exhaust tube 14 against the wall of the counter bore 6*e*, and also the surface area of contact between the exhaust tube 14 and the wall of the counter bore 6*e*.

One aspect of the present invention is recognition that while plastic exhaust tubes offer many advantages, a persistent problem has been that such exhaust tubes tend to loosen during their service life when compared to exhaust tubes made of aluminum, steel, or other suitable materials (collectively, "other suitable materials"). The embodiments of the present invention described below are primarily focused on an apparatus and method for securing a plastic exhaust tube in counter bore of a bit to reduce the likelihood that the exhaust tube will come loose during ordinary operation of the DTH drill. The invention is applicable, however, to securing substantially any cylindrical members within a component of a DTH drill in a bore or counter bore in the component.

SUMMARY

In one embodiment, the invention provides a retaining assembly for a cylindrical member in a DTH drill that includes a component including a component bore having a component bore diameter, the assembly comprising: a cylindrical member having a cylindrical member outer diameter larger than the component bore diameter and including a cylindrical member bore defining a cylindrical member inner diameter, the cylindrical member having a cylindrical member rigidity; and a support sleeve having an outer sleeve diameter less than the cylindrical member inner diameter and inserted into the cylindrical member bore to form a cylindrical member and sleeve assembly, at least a portion of the support sleeve having a rigidity greater than the cylindrical member rigidity; wherein the cylindrical member and sleeve assembly is inserted into the component bore such that the cylindrical member deforms against the support sleeve to fit within the component bore, such that the cylindrical member is fixedly sandwiched between the support sleeve and the component bore.

In some embodiments, the component of the DTH drill includes a bit; the cylindrical member includes an exhaust tube; the cylindrical member bore includes a through bore in the exhaust tube; and the cylindrical member and support sleeve assembly defines a foot valve assembly for the DTH drill, the foot valve assembly being adapted to be alternatingly placed into and out of communication with at least one chamber of the DTH drill for the flow of motive fluid through the exhaust tube through bore.

In some embodiments, the cylindrical member and support sleeve assembly includes a gap between the support sleeve and the cylindrical member bore prior to insertion of the cylindrical member and support sleeve assembly into the component bore; and deformation of the cylindrical member during insertion into the component bore closes the gap and causes the cylindrical member to apply pressure to the support sleeve.

In some embodiments, the cylindrical member bore extends through the cylindrical member from a first end of the cylindrical member to a second end opposite the first end; the cylindrical member bore includes a smaller diameter portion between the first end and a transition point, and a larger diameter portion between the transition point and the second end; and the support sleeve is inserted into the larger diameter portion of the cylindrical member bore to form the cylindrical member and sleeve assembly.

In some embodiments, the cylindrical member includes a retaining rim; the retaining rim defines an opening having a smaller diameter than the outer sleeve diameter, such that upon insertion of the support sleeve into the cylindrical member bore, the retaining rim engages a portion of the support sleeve to resist removal of the support sleeve from the cylindrical member bore. In some embodiments, the support sleeve includes a beveled surface to facilitate insertion of the support sleeve through the opening defined by the retaining rim. In some embodiments, the support sleeve includes a cut-out that mates with the retaining rim upon insertion of the support sleeve into the cylindrical member bore. In some embodiments, the retaining rim is included in an end of the cylindrical member; and an end of the support sleeve is engaged by the retaining rim to maintain an end of the support sleeve adjacent the end of the cylindrical member. In some embodiments, the cylindrical member includes first and second opposite ends and the support sleeve includes first and second opposite ends; and the retaining rim is positioned within the cylindrical member bore such that neither of the first and second opposite ends of the support sleeve is adjacent either of the first and second opposite ends of the cylindrical member.

In some embodiments, a wall of at least one of the cylindrical member and support sleeve is tapered. In some embodiments, the component bore includes a shoulder against which both the cylindrical member and support sleeve abut upon insertion of the cylindrical member and support sleeve assembly into the component bore.

In some embodiments, the support sleeve includes a longitudinally-extending slit defined by longitudinally-extending free ends; and deformation of the cylindrical member upon insertion of the cylindrical member and support sleeve assembly into the component bore applies pressure on the support sleeve sufficient to bring the free ends into contact and close the longitudinally-extending slit; and contact of the free ends enables the support sleeve to resist additional pressure applied by the cylindrical member on the support sleeve such that additional deformation of the cylindrical member occurs after the free ends have come into contact.

In some embodiments, the support sleeve defines a non-circular cross-section and the cylindrical bore defines a circular cross-section; and upon insertion of the cylindrical member and support sleeve assembly into the component bore the support sleeve is forced into a circular cross-section under pressure applied by the cylindrical member. In some embodiments, the non-circular cross-section of the support sleeve defines an oval having a major axis and a minor axis; the support sleeve contacts a surface of the cylindrical member bore at the major axis of the support sleeve upon insertion of the support sleeve into the cylindrical member bore; and contact of the support sleeve and surface of the cylindrical member bore creates an interference fit between the support sleeve and the surface of the cylindrical member bore sufficient to resist removal of the support sleeve from the cylindrical member and sleeve assembly.

In some embodiments, the support sleeve includes a portion of first rigidity and a portion of second rigidity lower than the first rigidity; the portion of second rigidity deforms during insertion of the cylindrical member and sleeve assembly into the component bore; and the cylindrical member is fixedly sandwiched between the portion of first rigidity and the component bore. In some embodiments, the portion of second rigidity includes rigidity-reducing features. In some embodiments, the portion of second rigidity includes at least one of a slit, a hole, and castellations.

In another embodiment, the invention provides a retaining assembly for a cylindrical member in a DTH drill that includes a component including a component bore having a component bore diameter, the assembly comprising: a generally cylindrical member including a cylindrical member outer surface defining a cylindrical member outer diameter, and a cylindrical member inner surface defining a cylindrical member inner diameter, the generally cylindrical member having a cylindrical member rigidity; and a support sleeve including an outer surface defining a support sleeve outer diameter, at least a portion of the support sleeve having a rigidity greater than the cylindrical member rigidity; wherein a larger diameter portion of the support sleeve has an outer diameter larger than the inner diameter of a smaller diameter portion of the generally cylindrical member; wherein the support sleeve is adapted for insertion into the component bore to define a gap between at least a portion of the support sleeve outer surface and the component bore; wherein the generally cylindrical member is adapted for insertion into the gap between the support sleeve outer surface and the component bore; and wherein the generally cylindrical member is adapted to deform upon the smaller diameter portion of the generally cylindrical member being forced over the larger diameter portion of the support sleeve, such deformation of the cylindrical member filling the gap and fixedly sandwiching the generally cylindrical member between the support sleeve and the component bore.

In some embodiments, the component of the DTH drill includes a bit; the generally cylindrical member includes an exhaust tube; and the generally cylindrical member and support sleeve together define a foot valve assembly for the DTH drill, the foot valve assembly being adapted to be alternatingly placed into and out of communication with at least one chamber of the DTH drill for the flow of motive fluid through the exhaust tube. In some embodiments, the support sleeve includes a beveled surface to facilitate insertion of the generally cylindrical member into the gap. In some embodiments, the component bore is tapered; the outer and inner surfaces of the generally cylindrical member are tapered; and the outer surface of the support sleeve is tapered. In some embodiments, the component bore includes a shoulder against which at least the support sleeve abuts upon fixedly sandwiching the generally cylindrical member between the support sleeve and the component bore. In some embodiments, the support sleeve includes a portion of first rigidity and a portion of second rigidity lower than the first rigidity; the portion of second rigidity deforms during insertion of the generally cylindrical member into the gap; and the generally cylindrical member is fixedly sandwiched between the portion of first rigidity and the component bore.

In another embodiment, the invention provides a method for inserting a cylindrical member into a bore of a component in a DTH drill, the bore having a component bore diameter, the method comprising: (a) providing a cylindrical member including a cylindrical member bore and having a cylindrical member rigidity; (b) providing a support sleeve having an outer surface, at least a portion of the support sleeve having a rigidity greater than the cylindrical member rigidity; and (c) deforming the cylindrical member against the component bore and the outer surface of the support sleeve to fixedly sandwiched the cylindrical member between the support sleeve and the component bore.

In some embodiments, the method further comprises the step of (b') inserting the support sleeve into the cylindrical member bore prior to step (c) to define a cylindrical member and sleeve assembly; and step (c) includes inserting the cylindrical member and sleeve assembly into the component bore. In some embodiments, step (b') includes defining a gap between the outer surface of the support sleeve and the cylindrical member bore; and step (c) includes deforming the cylindrical member to close the gap and apply pressure to the support sleeve. In some embodiments, step (a) includes providing a retaining rim in the cylindrical member, the retaining rim defining an opening of smaller diameter than an outer diameter of at least a portion of the outer surface of the support sleeve; and step (b') includes resisting removal of the support sleeve from the cylindrical member bore with the retaining rim. In some embodiments, step (b) includes providing a cut-out in the support sleeve; and resisting removal of the support sleeve from the cylindrical member bore includes engaging the cut-out of the support sleeve with the retaining rim. In some embodiments, providing a retaining rim includes positioning the retaining rim in an end of the cylindrical member; and resisting removal of the support sleeve includes maintaining an end of the support sleeve adjacent the end of the cylindrical member. In some embodiments, step (a) includes providing a cylindrical member having first and second opposite ends; step (b) includes providing a support sleeve having first and second opposite ends; and resisting removal of the support sleeve includes maintaining neither of the first and second opposite ends of the support sleeve adjacent either of the first and second opposite ends of the cylindrical member. In some embodiments, step (a) includes defining a circular cross-section with the cylindrical member bore; step (b) includes defining a non-circular cross-section with the outer surface of the support sleeve; and step (c) includes forcing the support sleeve outer surface into a circular cross-section under pressure applied by the cylindrical member deforming against the support sleeve. In some embodiments, step (b) includes defining with the cross-section of the outer surface of the support sleeve an oval having a major axis and a minor axis; step (b') includes contacting the cylindrical member bore with the support sleeve at the major axis to create an interference engagement between the support sleeve and the cylindrical member bore sufficient to resist removal of the support sleeve from the cylindrical member bore.

In some embodiments, at least one of steps (a) and (b) includes providing a tapered surface in at least one of the cylindrical member and support sleeve. In some embodiments, the component bore defines a shoulder at its bottom; and step (c) includes abutting at least one of the cylindrical member and support sleeve against the shoulder in the component bore. In some embodiments, step (b) includes providing a longitudinally-extending slit defined by longitudinally-extending free ends in the support sleeve; step (c) includes deforming the cylindrical member to apply pressure on the support sleeve sufficient to bring the free ends into contact and close the longitudinally-extending slit; and step (c) further includes continuing deformation of the cylindrical member against the support sleeve after the free ends are in contact.

In some embodiments, step (b) includes providing a support sleeve that includes a portion of first rigidity and a portion of second rigidity lower than the first rigidity; wherein step (c) includes deforming the portion of second rigidity and fixedly sandwiching the cylindrical member between the portion of first rigidity and the component bore. In some embodiments, step (b) further includes providing the portion of second rigidity with rigidity-reducing features in the support sleeve. In some embodiments, step (b) further includes providing at least one of slots, holes, and castellations in the portion of second rigidity.

In some embodiments, step (a) includes providing a cylindrical member having a generally cylindrical portion, and defining in the cylindrical member bore a smaller diameter portion; step (b) includes providing a larger diameter portion of the outer surface of the support sleeve, the larger diameter portion having a diameter larger than the smaller diameter portion; step (c) includes inserting the support sleeve into the component bore to define a gap between at least a portion of the support sleeve outer surface and the component bore, inserting the generally cylindrical portion into the gap, and deforming the generally cylindrical portion upon the smaller diameter portion of the cylindrical member bore being forced over the larger diameter portion of the support sleeve. In some embodiments, the component bore is tapered; step (a) includes providing tapered inner and outer surfaces of the generally cylindrical portion; and step (b) includes providing a tapered outer surface of the support sleeve.

Other aspects of the invention will become apparent by consideration of the detailed description and accompanying drawings.

DETAILED DESCRIPTION

Figure 1A:
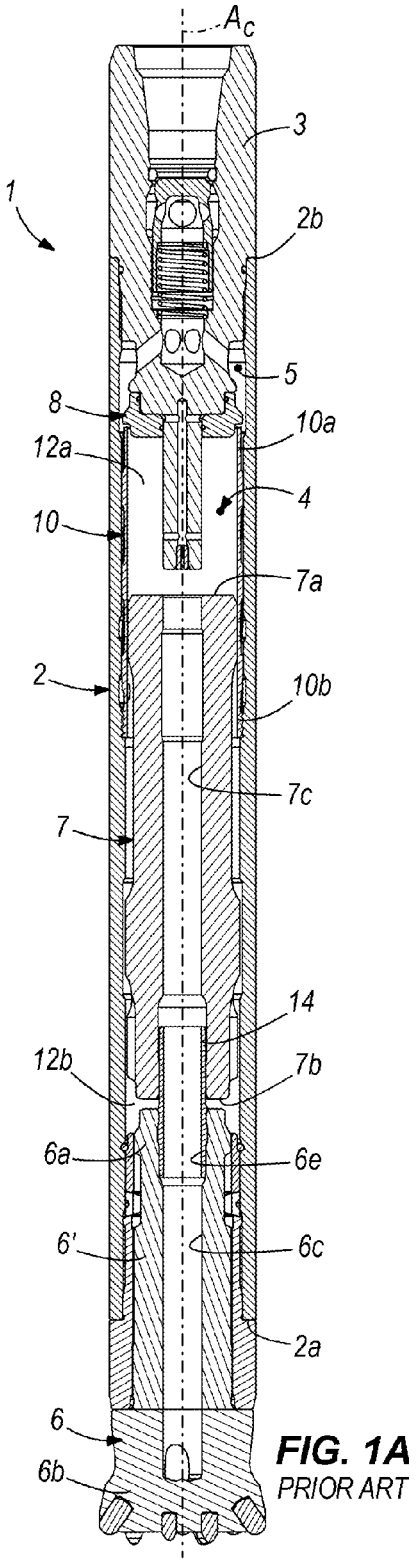
FIG. 1A PRIOR ART
FIG. 1A illustrates a representative prior art DTH drill in a first operating position.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Certain terminology is used in the following description for convenience only and is not limiting. The words "right," left," "lower," "upper," "upward," "down," and "downward" designate directions in the drawings to which reference is made. The words "inner," "inwardly," and "outer," "outwardly," refer to directions toward and away from, respectively, a designated centerline or a geometric center of an element being described, the particular meaning being readily apparent from the context of the description. Further, as used herein, the word "connected" is intended to include direct connections between two members without any other members interposed therebetween and indirect connections between members in which one or more other members are interposed therebetween. The terminology includes the words specifically mentioned above, derivatives thereof, and words of similar import.

We have identified that reasons for the loosening of plastic exhaust tubes in the counter bore include creep (also called "relaxation") and contraction (collectively "material property change") of the plastic material during the service life of the plastic exhaust tube. Creep is the tendency of a solid material to slowly move or deform permanently under the influence of stresses. Creep occurs as a result of long term exposure to levels of stress that are below the yield strength of the material. Creep increases with increased temperatures, and is more severe in materials that are subjected to heat (e.g., near the melting point of the material) for long periods. The rate of deformation arising from creep is a function of material properties, exposure time, exposure temperature, and the applied structural load. So, for a given plastic exhaust tube, the rate of creep is a function of temperature and applied structural load.

The applied structural load on an exhaust tube, once installed, arises from the interference fit with the counter bore. Paradoxically, the tighter an exhaust tube is fit into the counter bore of a bit (i.e., the tighter the interference fit and higher the resultant pressure), the faster it will loosen because of the resulting pressure-induced creep in the plastic material. With respect to temperatures, the higher the operating temperatures are within the DTH drill, the more likely that creep rate will increase in the exhaust tube.

Figure 1B:
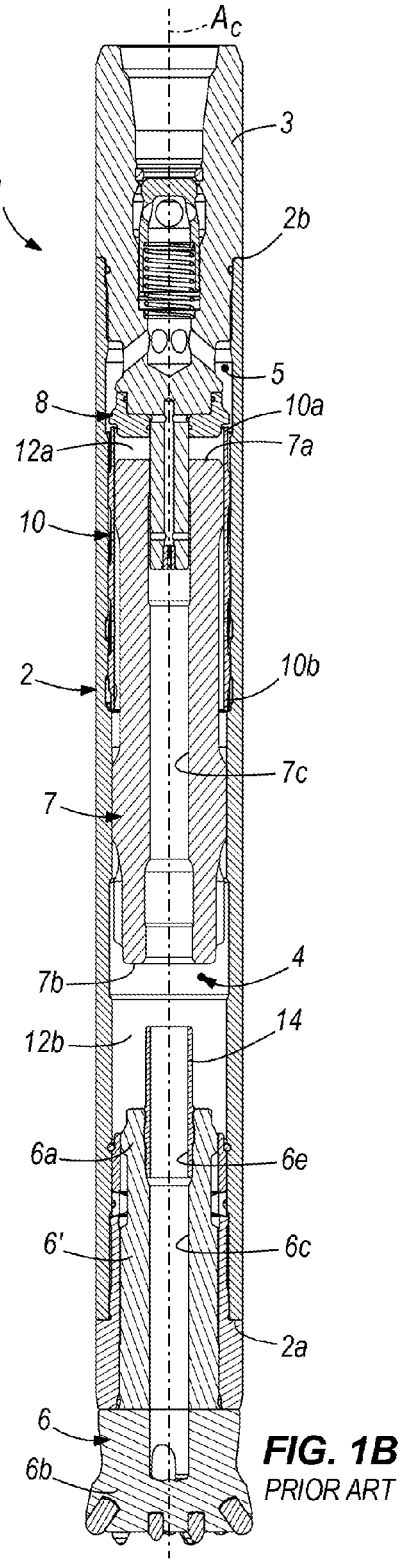
FIG. 1B PRIOR ART
FIG. 1B illustrates a representative prior art DTH drill in a second operating position.
Figure 1C:
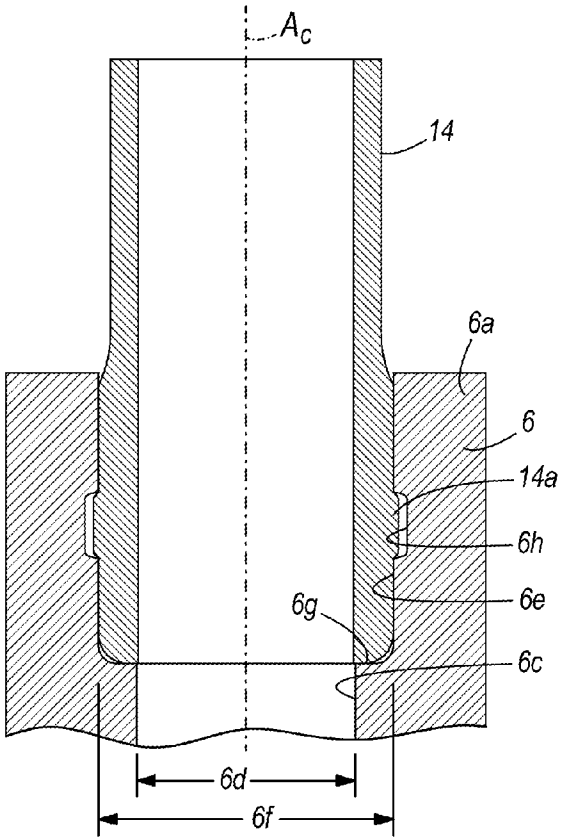
FIG. 1C PRIOR ART
FIG. 1C illustrates a representative prior art bit and exhaust tube assembly for a DTH drill.

Turning now to the several embodiments of the invention, all embodiments are illustrated and described for use in a DTH drill having the basic components of that illustrated in FIGS. 1A, 1B, and 1C. The reference numerals for the bit 6 and its various aspects (i.e., upper end 6*a*, lower end 6*b*, bore 6*c*, bore diameter 6*d*, counter bore 6*e*, counter bore diameter 6*f*, ring-shaped counter bore bottom 6*g*, and cavities 6*h*) shall be used below when a representative example of a known bit is helpful to an understanding of the invention. It will be appreciated, however that the present invention is applicable to other types of DTH drill bits and counter bores (including, but not limited to, counter bores having diameters that taper).

In all embodiments discussed below, an exhaust tube is reinforced on an inner surface with a support sleeve and the combination of the exhaust tube and support sleeve is referred to as a "foot valve assembly." Other embodiments may involving a cylindrical member that is not an exhaust tube, in which case the combination of the cylindrical member and the support sleeve may be referred to as a "cylindrical member and sleeve assembly" or a "sleeve-tube assembly." While exemplary exhaust tubes are constructed of Delrin® plastic material, the exhaust tube may be constructed of other suitable polymers, copolymers, ultra high molecular weight (UHMW) materials, composite materials (e.g., having different materials for the upper portion and lower portion), metals (e.g., softer metals that would be less rigid than the material of which the support sleeve is constructed) and other materials that will meet the specifications of the invention described in this specification and that are within the scope of the appended claims. The exhaust tube may include a stiffer upper portion to facilitate insertion of the foot valve assembly into the counter bore 6*e*. The stiffer upper portion may be provided by thickening the wall of the upper portion or by constructing the exhaust tube of a composite material that has a higher rigidity in the upper portion than in a lower portion. The exhaust tubes can be machined, cast, or molded for example.

Other suitable materials for the support sleeve include, but are not limited to, steel, aluminum, copper, glass-filled polymers and any other materials that will meet the specifications of the invention described in this specification. Generally desirable material properties for the support sleeve are high Young's modulus, low weight, good thermal stability, and high rigidity or stiffness. In all embodiments, at least a portion of the support sleeve is more rigid than the exhaust tube such that the exhaust tube can deform in the space between the support sleeve and the counter bore wall of the bit. Variations on the illustrated and described embodiments are within the scope of the invention, including but not limited to variations on one embodiment that includes features of another embodiment.

Additionally, although the embodiments discussed in this specification relate to the invention embodied in a foot valve assembly, the invention can be applied to substantially any cylindrical part inserted into a bore in a component of a DTH drill. For example, the invention may be applied to an apparatus and method for installing the air guide, air distributor, or control rod components of a DTH drill. The term "cylindrical member" is intended to include all types of tubes and cylinders, whether they include a through-bore, counter bore, or a blind bore.

It will be understood that in this specification, terms such as upper end, lower end, upper portion, lower portion, inner surface, outer surface, inner diameter, and outer diameter when used with reference to the exhaust tube, support sleeve, and foot valve assembly refer to the ordinary meaning of such terms corresponding to portions of the components as illustrated in the accompanying drawings. For the sake of simplifying the drawings, reference numerals may not be used to identify all such terms when they are deemed apparent to one of ordinary skill in the art. Additionally, it will be understood that a component having inner and outer surfaces (such as the support sleeve and exhaust tube) defines a wall between the inner and outer surfaces even though the wall may not be explicitly called out and labeled in the drawings, and that a bore (such as counter bore 6*e*) is necessarily bounded by a bore wall.

Figure 2A:
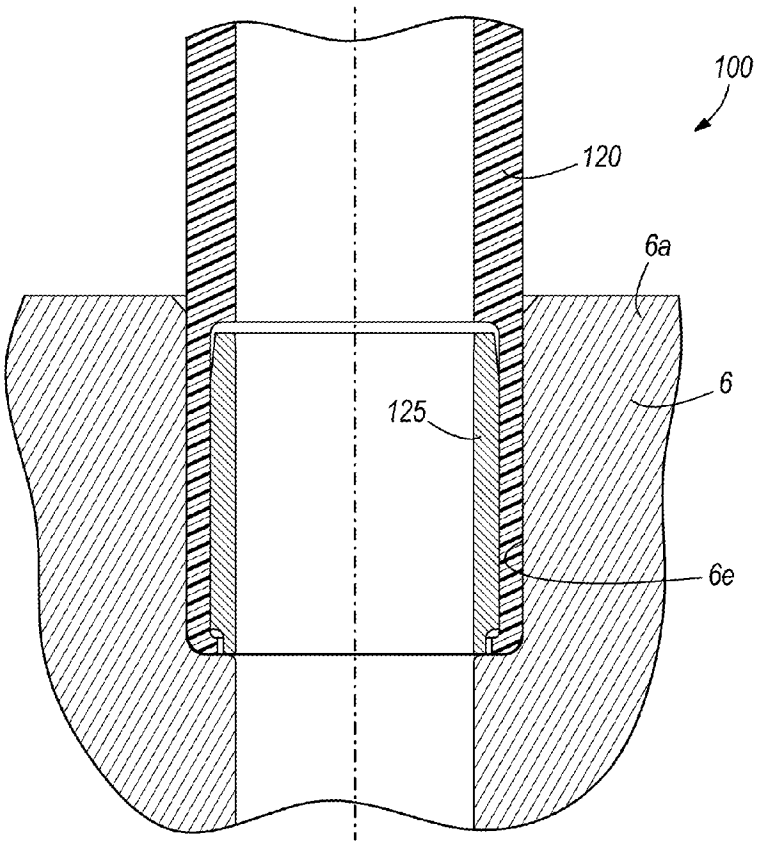
FIG. 2A is a cross-section view of a first embodiment of the present invention installed in a straight walled counter bore.
Figure 2B:
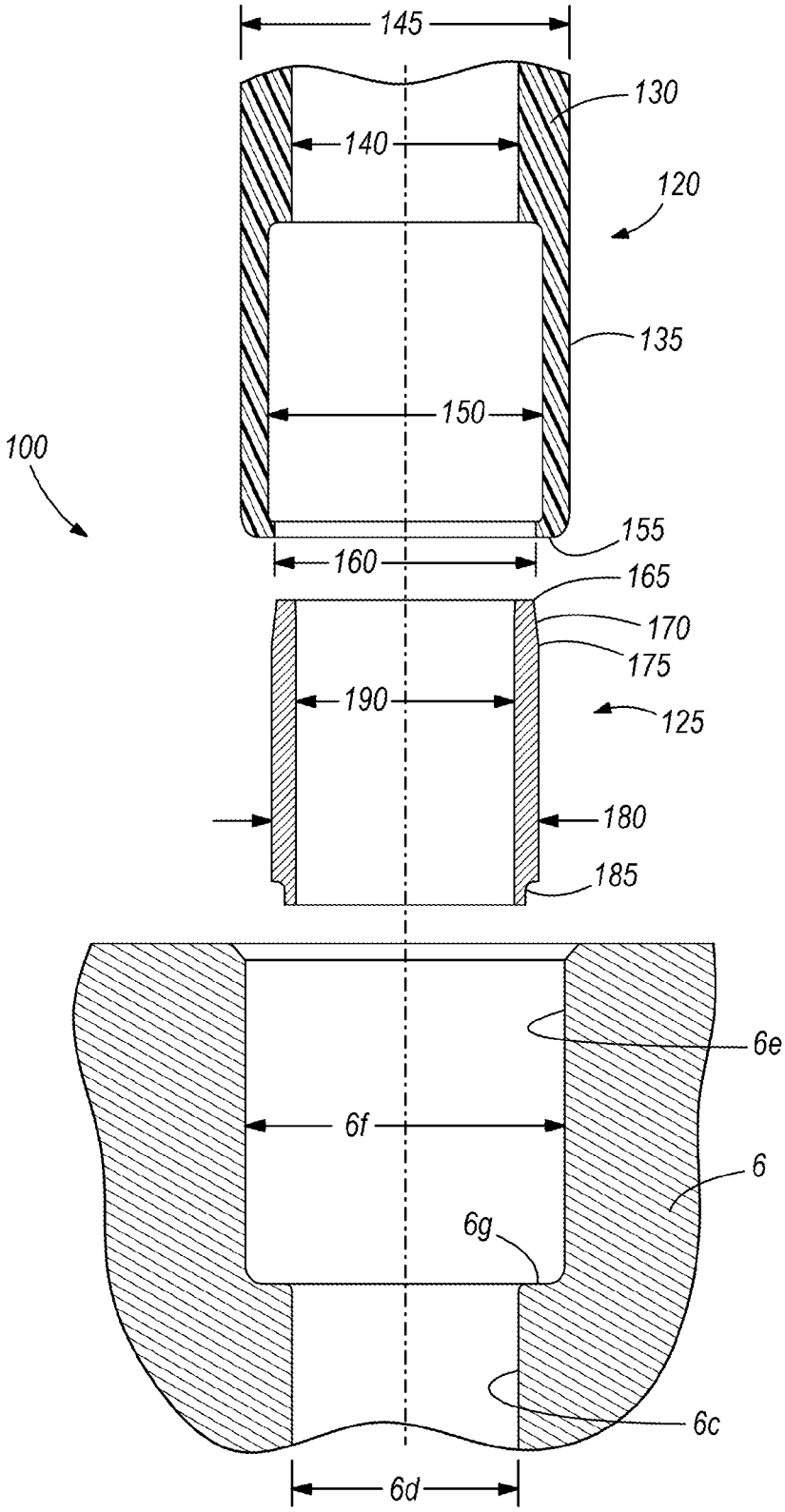
FIG. 2B is an exploded cross-section view of the first embodiment.
Figure 2C:
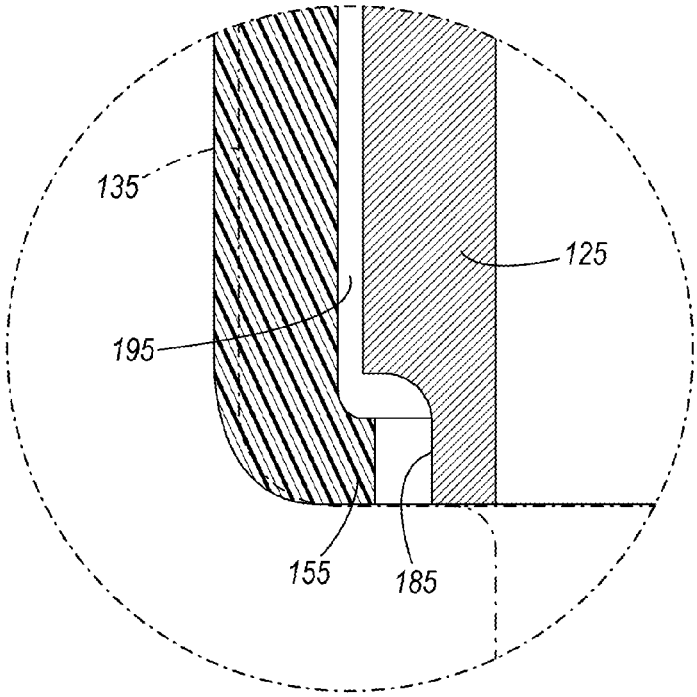
FIG. 2C is an enlarged cross-section view of a portion of the foot valve assembly of the first embodiment in a relaxed condition prior to insertion into the counter bore.

A first embodiment of a foot valve assembly 100 is illustrated in FIGS. 2A, 2B, 2C, 2D, and 2E. The foot valve assembly 100 includes an exhaust tube 120 and a support sleeve 125, and is illustrated in FIG. 2A as being installed in a straight walled counter bore 6*e* (i.e., a counter bore 6*e* having no cavities 6*h*). Referring to FIG. 2B, the exhaust tube 120 is a generally cylindrical member having a through bore, and includes an upper portion 130 that extends above the upper end 6*a* of the bit 6 and a lower portion 135 that is inserted into the counter bore 6*e* of the bit 6. The portion of the through bore where the upper portion 130 of the through bore meets the lower portion 135 of the through bore may be termed the "transition point" of the through bore. The inner diameter 140 of the through bore in the upper portion 130 is about equal to the diameter 6*d* of the bit bore 6*c*. The lower portion 135 of the exhaust tube 120 may include an outer diameter 145 that is different from or the same as the outer diameter of the upper portion 130. In any event, the undeformed outer diameter 145 of the lower portion 135 of the exhaust tube 120 is slightly larger than the diameter 6*f* of the counter bore 6*e*. The portion of the through bore in the lower portion 135 of the exhaust tube 120 includes an inner diameter 150 that is larger than the inner diameter 140 of the through bore in the upper portion 130. The bottom edge of the exhaust tube 120 includes an integral retaining ring or rim 155 that defines a circular opening having a diameter 160 greater than the inner diameter 140 of the upper portion 130 but less than the inner diameter 150 of the lower portion 135.

The support sleeve 125 is generally cylindrical, and includes an upper end 165 defining a beveled surface 170 that defines an angle of zero to thirty degrees (0°-30°) with respect to the centerline Ac of the sleeve 125, such that the outer diameter of the support sleeve 125 increases from the upper end 165 to a bottom end 175 of the beveled surface 170. In one representative embodiment, the angle is between zero to ten degrees (0°-10°), and in another embodiment, the angle is two-and-a-half degrees (2.5°). The beveled surface 170 facilitates insertion of the support sleeve 125 into the exhaust tube 120 through the retaining rim 155. The outer diameter 180 of the support sleeve 125 below the beveled surface 170 (referred to simply as the outer diameter of the support sleeve 125) is slightly less than the inner diameter 150 of the exhaust tube 120. At its lower end, the support sleeve 125 includes a cut-out 185 in its outer surface that has a depth and height sufficient to accommodate the retaining rim 155 of the exhaust tube 120. In other embodiments, the cut-out 185 may be between the upper and lower ends of the support sleeve 125 and the retaining rim 155 may be between the upper and lower ends of the bore of the exhaust tube 120. An inner diameter 190 of the support sleeve 125 is about equal to the inner diameter 140 of the upper portion 130 of the exhaust tube 120 and the diameter 6*d* of the bit bore 6*c*. The support sleeve 125 may be made of, for example, steel having a hardness of 20-55 HRc, and preferably 30-45 HRc. The thickness of the support sleeve in the illustrated embodiment should be 1.0-5.0 mm, and preferably 1.5-2.5 mm.

The first embodiment of the foot valve assembly 100 is assembled by inserting the support sleeve 125 into the lower portion 135 of the exhaust tube 120 through the retaining rim 155. The retaining rim 155 deflects as the support sleeve 125 is inserted, and snaps back to its original condition once the lower edge of the support sleeve 125 has cleared the retaining rim 155, such that the retaining rim 155 is received within the cut-out 185. The retaining rim 155 resists the support sleeve 125 falling out of the exhaust tube 120 during handling of the foot valve assembly 100. The foot valve assembly 100 shall be referred to as being in its undeformed state before it is installed in the counter bore 6*e*. In the undeformed state, a small gap 195 (see FIG. 2C) is defined between the inner surface of the lower portion 135 of the exhaust tube 120 and the outer surface of the support sleeve 125.

Figure 2D:
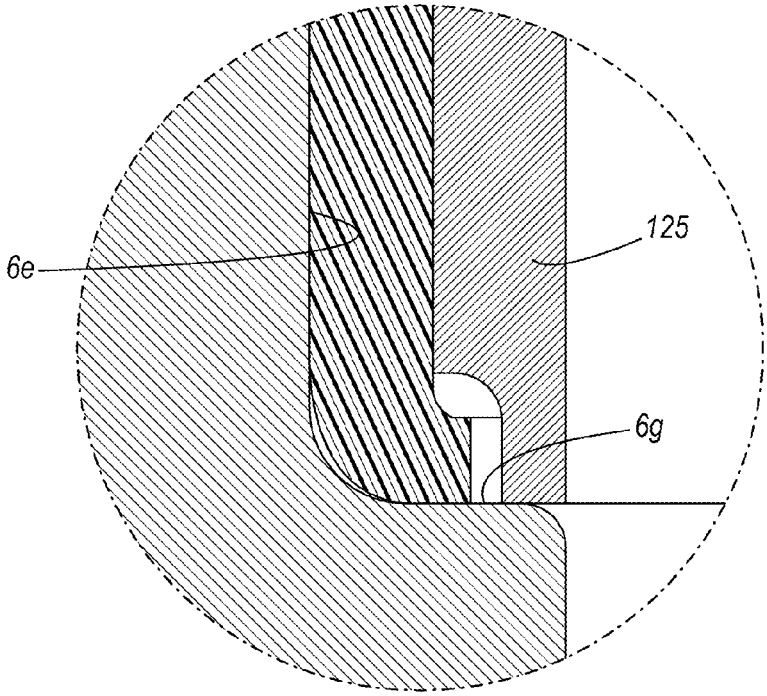
FIG. 2D is an enlarged cross-section view of the portion of the foot valve assembly illustrated in FIG. 2C after the assembly has been inserted into the counter bore.

With reference now to FIG. 2D, the foot valve assembly 100 is inserted into the counter bore 6*e* until the lower end 155 of the exhaust tube 120 abuts the shoulder 6*g* at the bottom of the counter bore 6*e*. The lower edge of the support sleeve 125 (the portion of the sleeve at the bottom of the cut-out 185) also sits on the shoulder 6*g*. In other embodiments, it may not be necessary to have the support sleeve 125 contact the shoulder 6*g*. The exhaust tube 120 deforms to fit within the diameter 6*f* of the counter bore 6*e*. The support sleeve 125 is more rigid than the exhaust tube 120, so even though the lower portion 135 of the exhaust tube 120 deforms against the support sleeve 125 and against the counter bore wall 6*e*, the support sleeve 125 is either undeformed or deforms only slightly compared to the deformation of the exhaust tube 120.

As used herein, the term "deform" and its derivatives includes elastic and plastic deflection and yielding of a material, whether by mechanical, thermal, or other loading. The load (mechanical, thermal, or other) at which a material will deform is referred to herein as the threshold load. Upon application of the threshold load, the lower portion 135 of the exhaust tube 120 can only deform a limited amount before the gap 195 is filled. Once the gap 195 is filled, the exhaust tube 120 will deform elastically as well as plastically. The stress state for much of the lower portion 135 of the sleeve 120 (i.e., most of the portion sandwiched between the support sleeve 125 and the counter bore wall 6*e*) is hydrostatic, but the top and bottom ends of the lower portion 135 of the exhaust tube 120 can still yield plastically after the gap 195 is filled.

Deformation of the exhaust tube 120 against the support sleeve 125 and the counter bore 6*e* gives rise to an interference fit which includes a frictional interface on the inner and outer surfaces of the exhaust tube 120. Once the foot valve assembly 100 is fully installed, the frictional interface between the exhaust tube 120 outer surface and the counter bore 6*e* wall is sufficient to resist removal of the foot valve assembly 100 from the counter bore 6*e* during ordinary operation of the DTH drill, and the exhaust tube 120 may be said to be "fixedly sandwiched" between the support sleeve 125 and the wall of the counter bore 6*e*. The rigid support afforded to the inner surface of the lower portion 135 of the exhaust tube 120 by the support sleeve 125 resists creep, relaxation, and other material property changes of the exhaust tube 120.

Figure 2E:
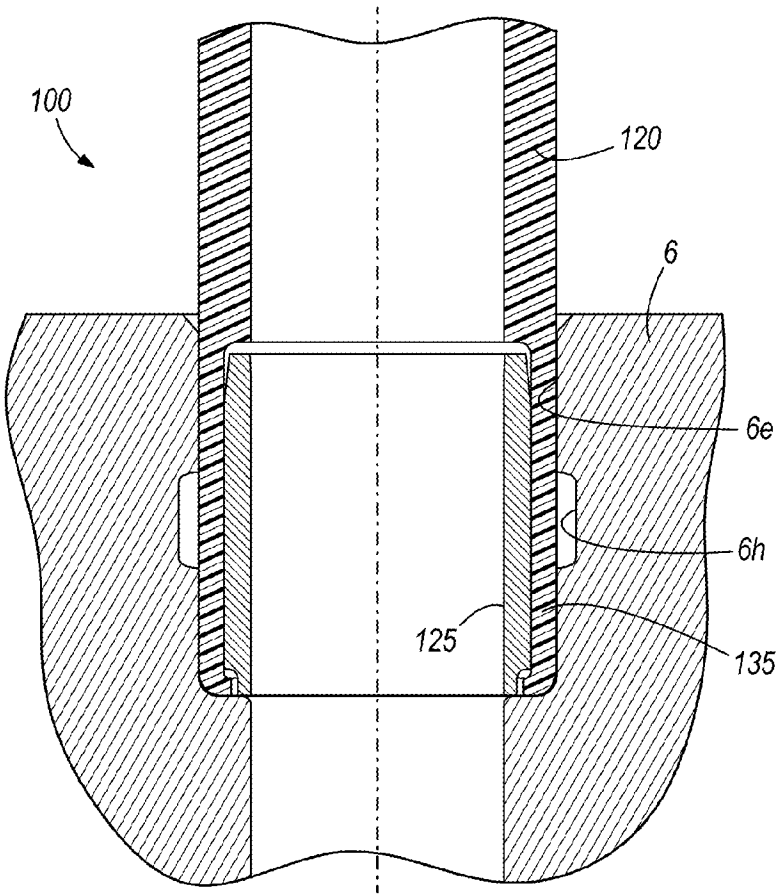
FIG. 2E is a cross-section view of the first embodiment of the foot valve assembly installed in a traditional counter bore.

FIG. 2E illustrates the first embodiment of the foot valve assembly 100, but inserted into a traditional bit counter bore 6*e*. More specifically, the counter bore 6*e* includes cavities 6*h*. The outer surface of the exhaust tube 120 extends across the cavities 6*h* in this type of counter bore 6*e*. The overall surface area of the interference fit between the exhaust tube 120 and the counter bore 6*e* is reduced due to the cavities 6*h*, but there is still sufficient surface area to fixedly sandwich the foot valve assembly 100 within the counter bore 6*e*.

Figure 3:
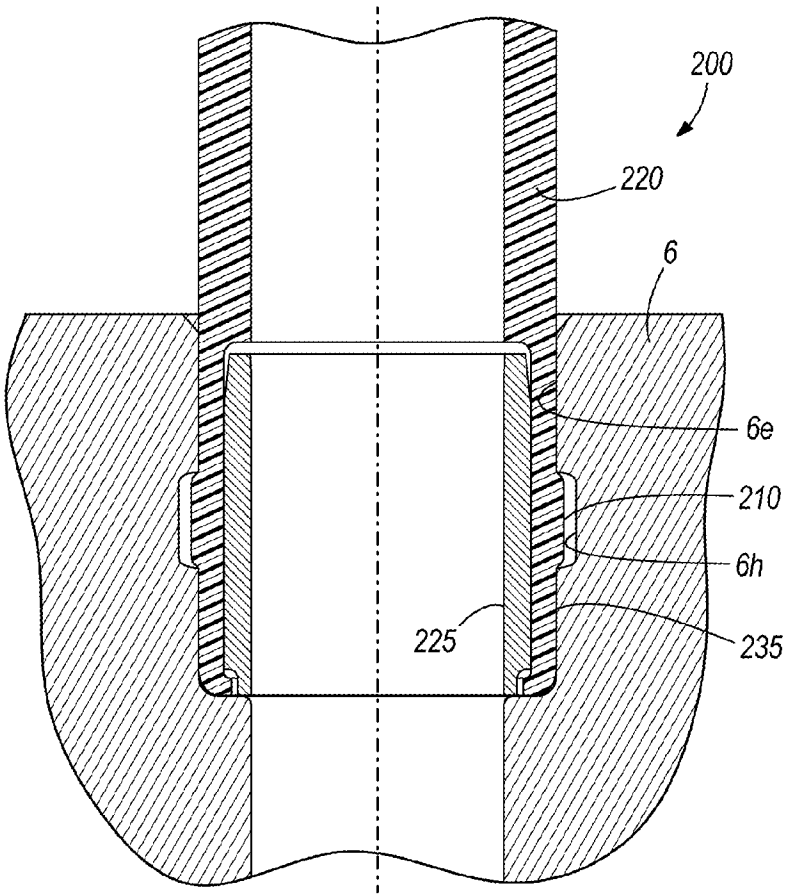
FIG. 3 is a cross-section view of a second embodiment of the foot valve assembly installed in a counter bore.

FIG. 3 illustrates a second embodiment of the foot valve assembly 200 that includes an exhaust tube 220 and a support sleeve 225. The exhaust tube 220 includes a lower portion 235 that has humps 210 that mate with cavities 6*h* in a traditional bit counter bore 6*e*. Otherwise the foot valve assembly 200, its method of assembly, the method of inserting it into the counter bore 6*e*, and the theory of its operation, including fixedly sandwiching the exhaust tube 220 between the support sleeve 225 and the counter bore 6*e*, are the same as the first embodiment 100.

Figure 4B:
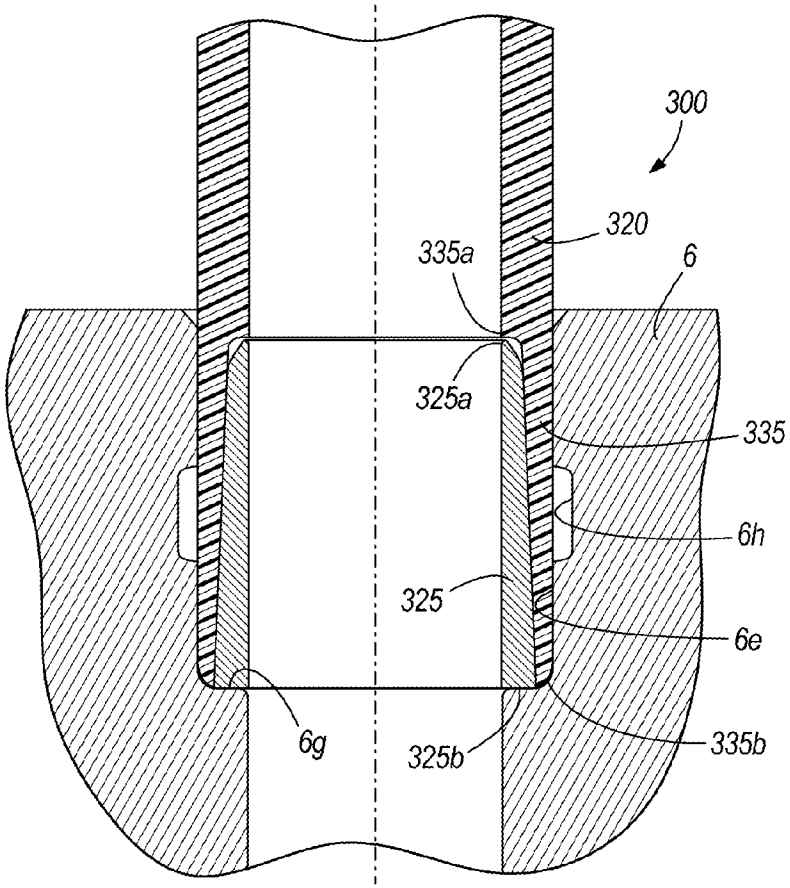
FIG. 4B is a cross-section view of a third embodiment of the foot valve assembly installed in a traditional counter bore.
Figure 4A:
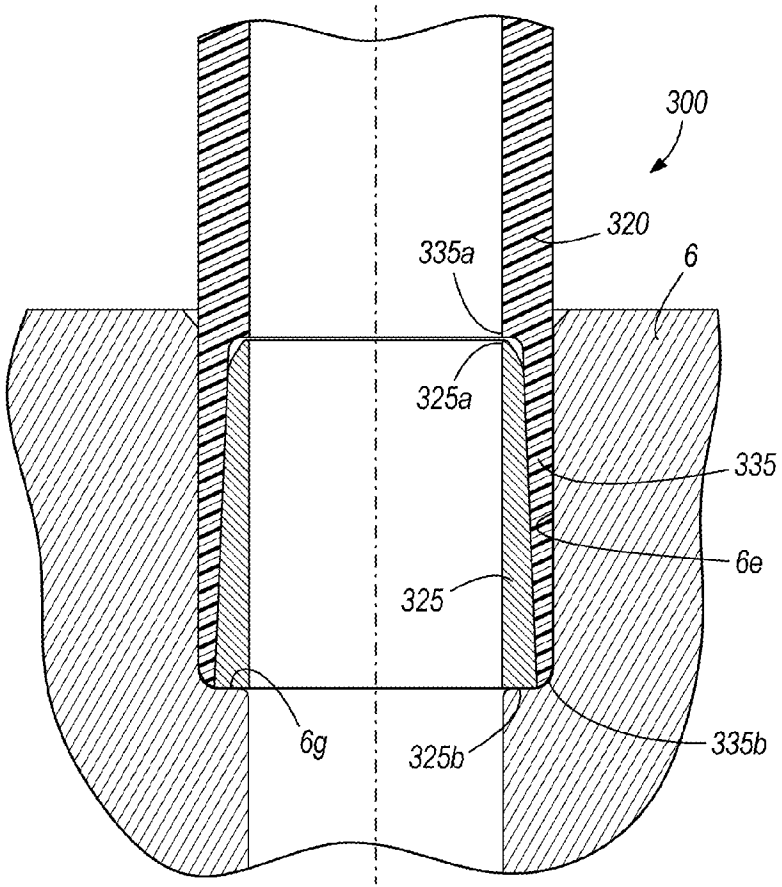
FIG. 4A is a cross-section view of a third embodiment of the foot valve assembly installed in a straight-walled counter bore.

FIGS. 4A and 4B illustrate a third embodiment of the foot valve assembly 300 that includes an exhaust tube 320 and a support sleeve 325. The exhaust tube 320 includes a lower portion 335. The exhaust tube 320 does not include a retaining rim at its lower end. In this embodiment 300, the inner surface of the lower portion 335 of the exhaust tube 320 and the outer surface of the support sleeve 325 are tapered. In other words, the diameter of the inner surface of the lower portion 335 increases from the top of the lower portion 335*a* to the bottom of the lower portion or distal end 335*b* of the exhaust tube 320, and the diameter of the outer surface of the support sleeve 325 increases from the top of the support sleeve 325*a* to the bottom of the support sleeve 325*b*. The taper is substantially linear for both the exhaust tube 320 and the support sleeve 325 in the illustrated embodiment, but could be non-linear in other embodiments or variations on this embodiment such as embodiments having a retaining rim. The outer surface of the lower portion 335 of the exhaust tube 320 and the inner surface of the support sleeve 325 are the same as in the first embodiment 100 (i.e., the surfaces have constant diameters top to bottom). As a consequence of the tapered surfaces, the wall of the lower portion 335 of the exhaust tube 320 is relatively thin at the distal end 335*b* and becomes linearly thicker toward the upper end 335*a*, and the wall of the support sleeve 325 is thicker at the lower end 325*b* and becomes linearly thinner moving up the support sleeve 325 to the upper end 325*a*.

In FIG. 4A, the third embodiment of the foot valve assembly 300 is installed in a straight walled counter bore 6*e*, and in FIG. 4B the same foot valve assembly 300 is inserted into a traditional counter bore 6*e* having cavities 6*h*. Regardless of the type of counter bore 6*e*, the support sleeve 325 is first placed in the counter bore 6*e*, resting on the shoulder 6*g* at the bottom of the counter bore 6*e*. The exhaust tube 320 is then inserted into the space between the support sleeve 325 and the wall of the counter bore 6*e*. Because of the tapered outer surface of the support sleeve 325, there is a significant gap between the top edge 325*a* of the support sleeve 325 and the wall of the counter bore 6*e*. The tapered outer surface of the lower portion 335 of the exhaust tube 320 makes the insertion of the exhaust tube 320 easier because the relatively thin distal end 335*b* is easily inserted into the relatively wide gap between the top 325*a* of the support sleeve 325 and the counter bore wall 6*e*. As the exhaust tube 320 is inserted further into the counter bore 6*e*, it meets with resistance as the inner and outer surfaces of the exhaust tube 320 come into contact with the support sleeve 325 and counter bore wall 6*e*. Before the distal end 335*b* of the exhaust tube 320 reaches the shoulder 6*g* at the bottom of the counter bore 6*e*, the exhaust tube 320 begins to deform. By the time the distal end 335*b* of the exhaust tube 320 abuts the shoulder 6*g* at the bottom of the counter bore 6*e*, the exhaust tube material has deformed to fill the gap between the support sleeve 325 and the counter bore wall 6*e* to fixedly sandwiched the exhaust tube 320 between the support sleeve 325 and the counter bore wall 6*e*.

Figure 5:
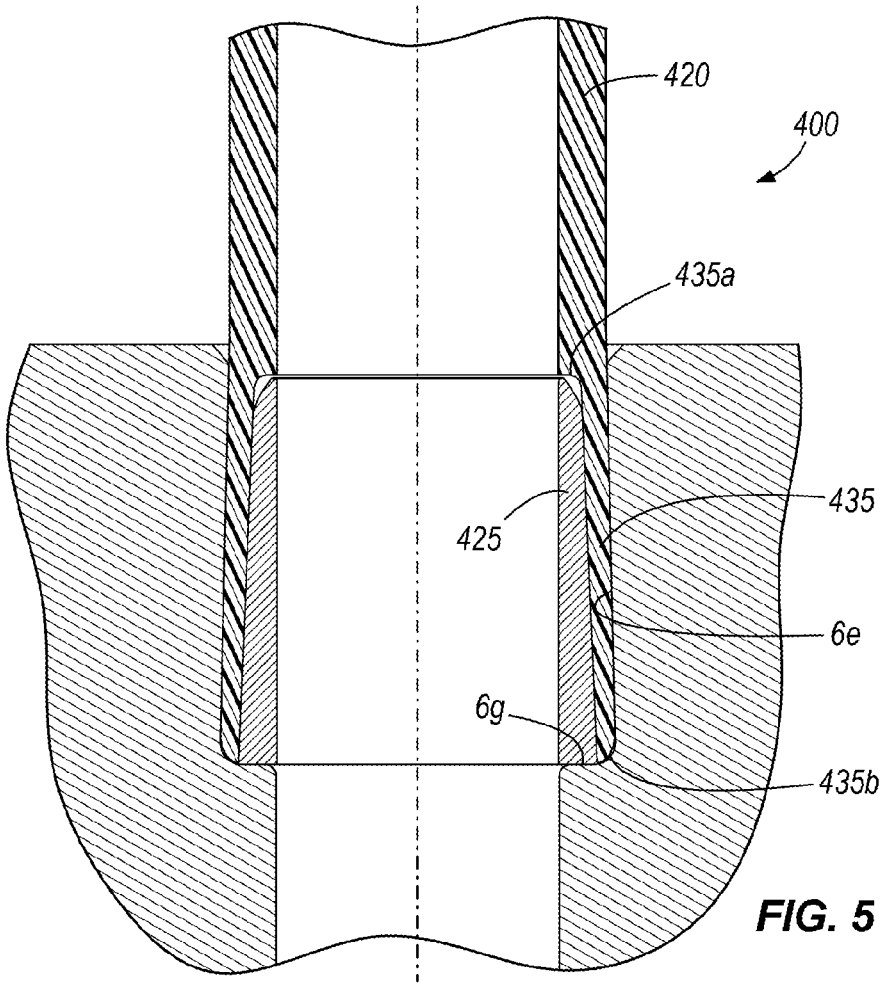
FIG. 5 is a cross-section view of a fourth embodiment of the foot valve assembly installed in a counter bore.

FIG. 5 illustrates a fourth embodiment of the foot valve assembly 400, which is similar to the third embodiment 300, except both the inner and outer surfaces of the lower portion 435 of the exhaust tube 420 are tapered. Consequently, the diameters of both the inner surface and the outer surface of the lower portion 435 increase from the top 435*a* to the bottom 435*b*. The support sleeve 435 in this embodiment is identical to what is described above for the third embodiment. The counter bore 6*e* includes a reverse taper, which increases in diameter from the top of the counter bore 6*e* to its bottom 6*g*. The tapered outer surface of the exhaust tube 420 and the reverse tapered counter bore are similar to those disclosed in co-pending U.S. patent application Ser. No. 11/919468 filed Oct. 29, 2007 and published as U.S. Patent Application Publication No. 2009/0308661-A1 on Dec. 17, 2009, the entire contents of which are incorporated herein by reference. Given that the outer surface of the exhaust tube 420 widens, at least in the lower portion 435, the exhaust tube 420 is not technically a cylindrical member. Nonetheless, because the angle of the taper of the outer surface is relatively small (e.g., about 0.5°-3.0° per the specification of U.S. patent application Ser. No. 11/919468), the exhaust tube 420 may be termed "generally cylindrical" or a "generally cylindrical member" for the purposes of this specification.

It should be noted that this embodiment can also be used in a traditional bit, either having straight walls that are parallel to the centerline Ac as in FIG. 4A or having cavities as in FIG. 4B. Additionally, if the counter bore 6*e* is not reverse tapered, the exhaust tube 420 may include a retaining rim at its distal end and the support sleeve 425 may be inserted into the exhaust tube 420 prior to insertion of the foot valve assembly 400 into the counter bore 6*e*.

Figure 6A:
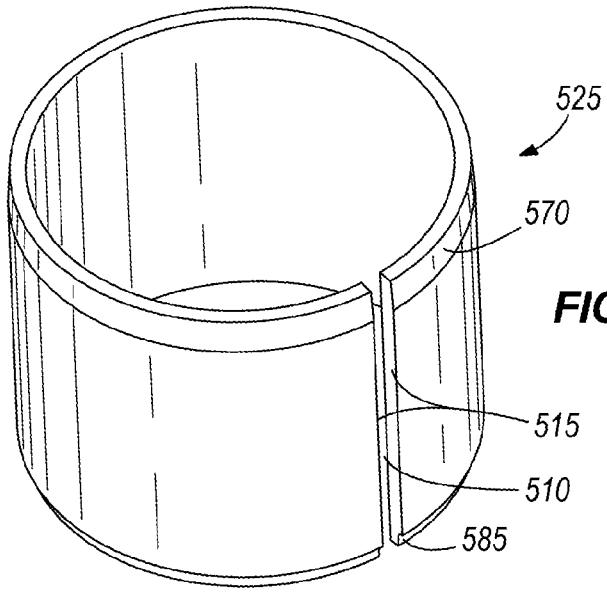
FIG. 6A is a perspective view of a support sleeve for a fifth embodiment of the foot valve assembly.
Figure 6B:
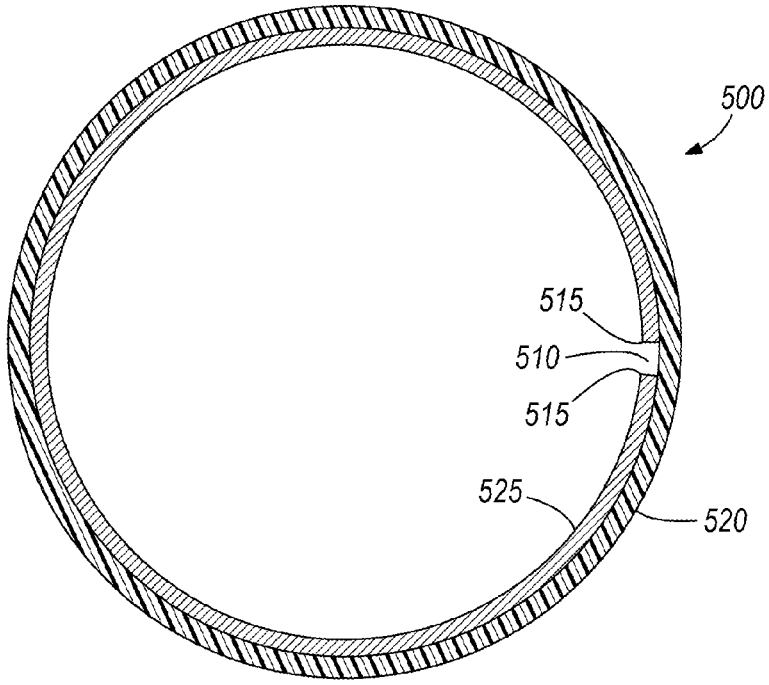
FIG. 6B is a cross-section view of the foot valve assembly of the fifth embodiment in a relaxed condition prior to insertion into the counter bore.
Figure 6C:
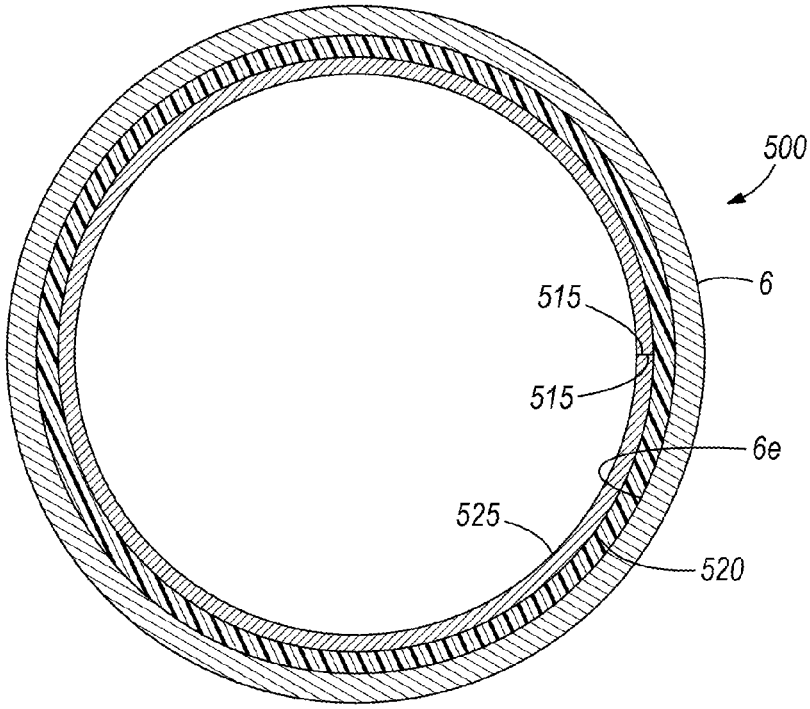
FIG. 6C is a cross-section view of the foot valve assembly of the fifth embodiment after the assembly has been inserted into the counter bore.

FIGS. 6A, 6B and 6C illustrate a fifth embodiment of the foot valve assembly 500 in which the support sleeve 525 includes a longitudinally-extending slit 510 defined by free ends 515. The width of the slit 510 is not necessarily drawn to scale in FIGS. 6A and 6B, and may be relatively small in a commercial embodiment. The exhaust tube 520 is substantially along the lines of any of the exhaust tubes in the above-described embodiments, such as the exhaust tube 120 in the first embodiment 100. The exhaust tube 520 may include a retaining rim similar to retaining rim 155 in FIG. 2B, with which a cut-out 585 at the bottom edge of the support sleeve 525 mates upon insertion of the support sleeve 525 into the exhaust tube 520.

With reference to FIG. 6B, when the support sleeve 525 is inserted into the exhaust tube 520, the support sleeve 525 is relaxed such that the free ends 515 are spaced apart and define the slit 510. With reference to FIG. 6C, once the foot valve assembly 500 is inserted into the counter bore 6*e*, the exhaust tube 520 deforms radially, which applies a closing pressure on the support sleeve 525. As a result of the radially-acting pressure, the free ends 515 are pushed together and the slit 510 is closed. Once the free ends 515 of the support sleeve 525 contact each other, the support sleeve 525 resists further radially-acting pressure and the exhaust tube 520 is sandwiched between the support sleeve 525 and the counter bore 6*e*, which gives rise to an interference fit that fixedly sandwiches the exhaust tube 520 in the counter bore 6*e*.

Figure 7A:
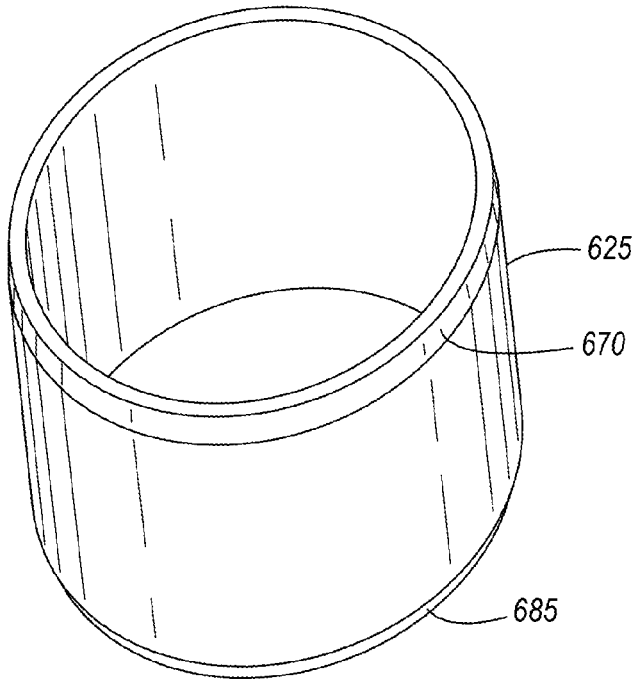
FIG. 7A is a perspective view of a support sleeve for a sixth embodiment of the foot valve assembly.
Figure 7B:
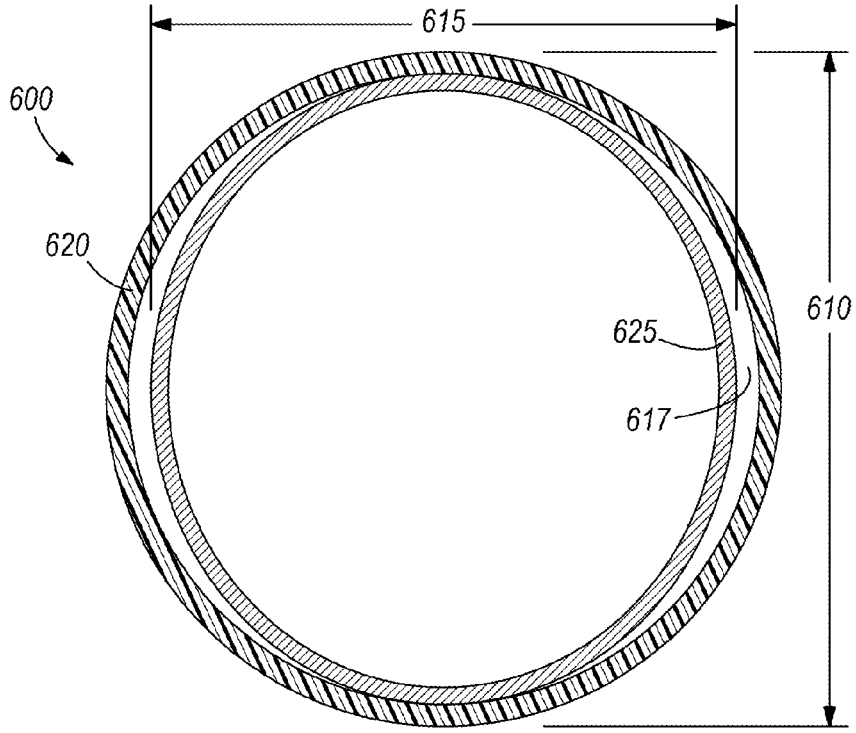
FIG. 7B is a cross-section view of the foot valve assembly of the sixth embodiment in a relaxed condition prior to insertion into the counter bore.
Figure 7C:
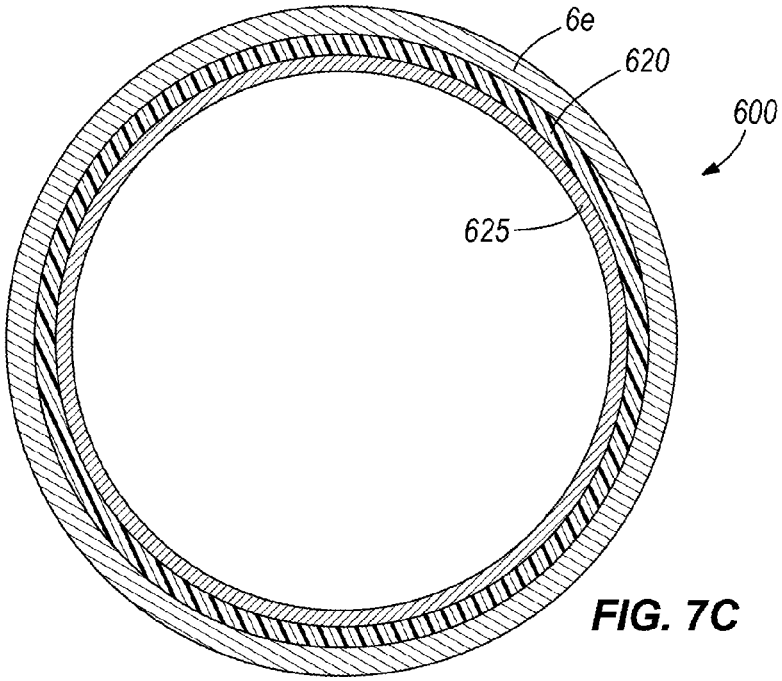
FIG. 7C is a cross-section view of the foot valve assembly of the sixth embodiment after the assembly has been inserted into the counter bore.

FIGS. 7A, 7B, and 7C illustrate a sixth embodiment of the foot valve assembly 600 in which the support sleeve 625 is similar to the support sleeve in the first through fourth embodiments, but has a generally oval cross-section with a major dimension 610 and a minor dimension 615. When installed in the exhaust tube 620 (FIG. 7B), the support sleeve 625 may touch the exhaust tube inner surface at the support sleeve's major axis 610, but a gap 617 is defined between the exhaust tube 620 and the rest of the support sleeve 625 outer surface. As the foot valve assembly 600 is inserted into the counter bore 6*e* (FIG. 7C), the support sleeve 625 is forced into round which closes the gap 617. Once the gap 617 has been closed, pressure from the deformed exhaust tube 620 is applied around the entire circumference of the support sleeve 625.

The exhaust tube 620 used with this embodiment may be substantially similar to any of the above-identified exhaust tubes in other embodiments, and may or may not include a retaining rim (similar to retaining rim 155 in FIGS. 2B, 2C, and 2D) at the bottom end. The support sleeve 625 may include a cut-out 685 to mate with such retaining rim. Friction between the support sleeve 625 and the exhaust tube 620 at the major axis 610 of the support sleeve 625 may be sufficient to retain the sleeve 625 within the exhaust tube 620 during assembly, in which case the retaining rim and cut-out 685 may be eliminated from this embodiment.

Figure 8:
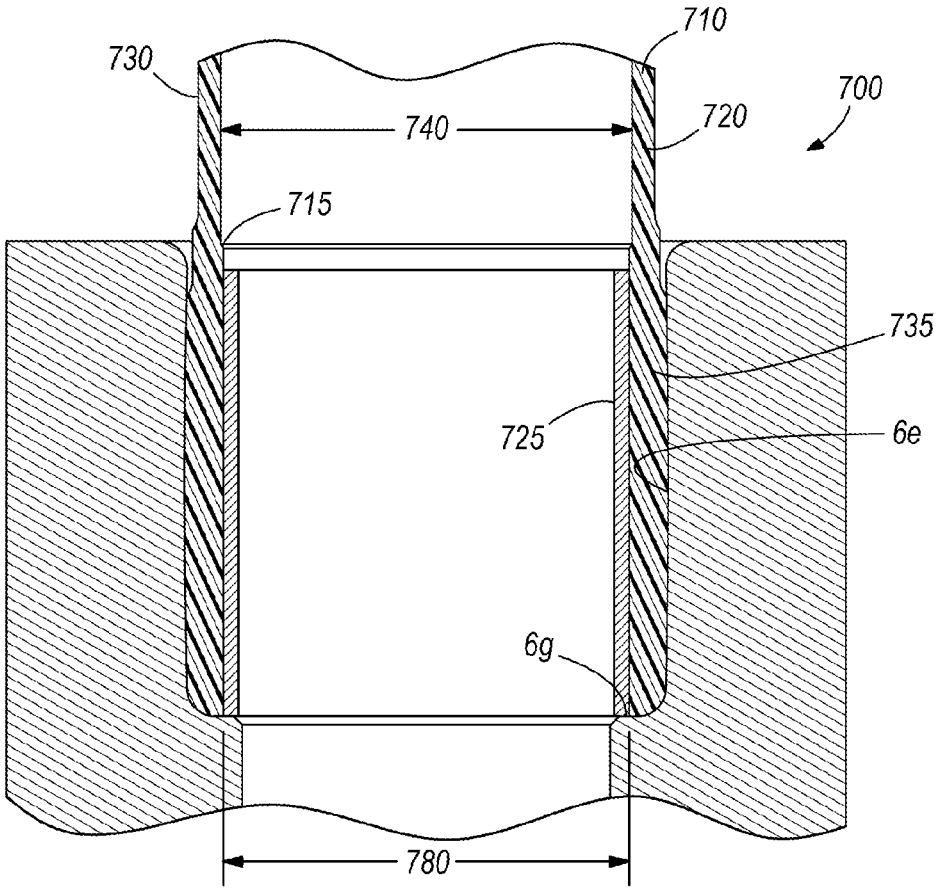
FIG. 8 is a cross-section view of the foot valve assembly according to a seventh embodiment installed in a counter bore.

FIG. 8 illustrates a seventh embodiment 700 in which the exhaust tube 720 is first installed into the counter bore 6*e*, and then the support sleeve 725 is inserted into the exhaust tube 720 from an upper end 710 of the exhaust tube 720. The outer diameter of the exhaust tube 720 should be less than the diameter 6*f* of the counter bore 6*e* in this embodiment so that a gap is defined between the outer surface of the exhaust tube 720 and the counter bore wall 6*e*. The inner diameter 740 of the upper portion 730 of the exhaust tube 720 is larger than the outer diameter 780 of the support sleeve 725 by four thousandths of an inch to one tenth of an inch (0.004"-0.100") to ease the passing of the support sleeve 725 to the lower portion 735 of the exhaust tube 720. In one embodiment, the inner diameter 740 is larger than the outer diameber 780 by between two to ten thousandths of an inch (i.e., 0.002" to 0.010"). At the transition from the upper portion 730 to the lower portion 735, the inner diameter of the exhaust tube 720 decreases at a chamfer 715 to a diameter slightly smaller than the outer diameter 780 of the support sleeve 725. The chamfer angle is preferably between zero and thirty degrees (0°-30°), and is in one embodiment ten degrees (10°). Continued insertion of the support sleeve 725 into the exhaust tube 720 applies pressure against the exhaust tube lower portion 735 to deform the lower portion 735 to fill the gap and push against the counter bore 6*e*. This generates the interference fit between the exhaust tube 720 and the support sleeve 725 and the counter bore 6*e*, with the result of the exhaust tube 720 being fixedly sandwiched within the counter bore 6*e*. The support sleeve 725 is inserted until its lower edge abuts the shoulder 6*g* at the bottom of the counter bore 6*e*. In a variation on this seventh embodiment, both the inner diameter and outer diameter of the exhaust tube 720 may provide a relatively small interference engagement with the respective support sleeve 725 and the counter bore 6*e*. This would be achieved by making the exhaust tube 720 outer diameter very slightly larger than the counter bore 6*e* diameter, and making the exhaust tube 720 inner diameter very slightly less than the outer diameter of the support sleeve 725.

Figure 9A:
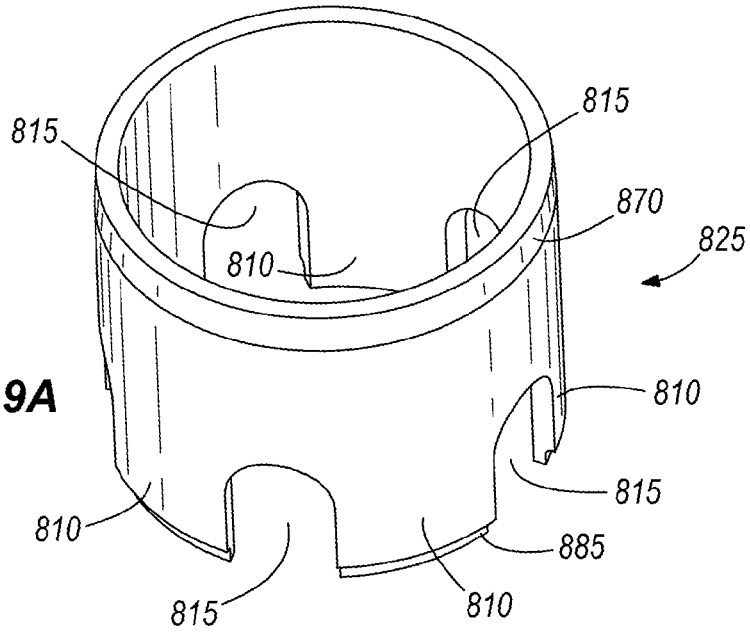
FIG. 9A is a perspective view of a support sleeve for an eighth embodiment of the foot valve assembly.
Figure 9B:
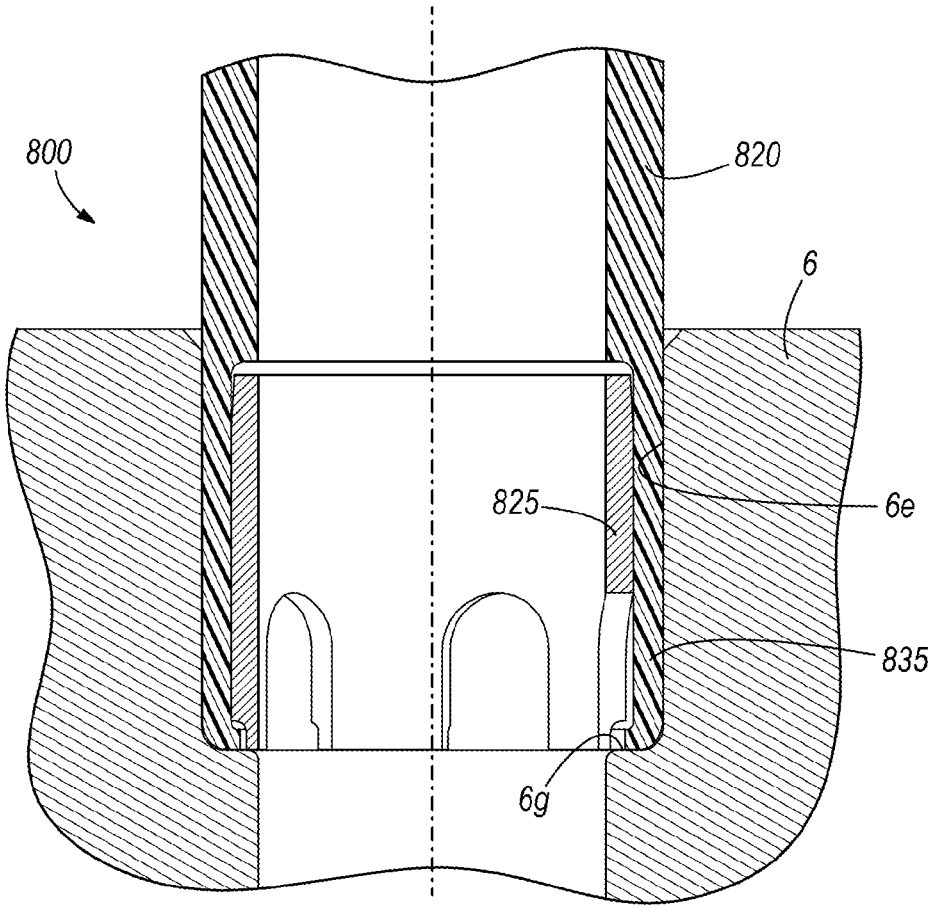
FIG. 9B is a cross-section view of the eighth embodiment of the foot valve assembly inserted into the counter bore.

FIGS. 9A and 9B illustrate an eighth embodiment of the foot valve assembly 800, which includes an exhaust tube 820 and a support sleeve 825. The exhaust tube 820 is substantially similar to the exhaust tube 120 of the first embodiment discussed above. The support sleeve 825 may include a cut-out 825 in its lower end to engage a retaining rim in the exhaust tube 820. The support sleeve 825 includes fingers 810 on its lower portion. The fingers 810 are spaced circumferentially such that gaps 815 are defined between them. Otherwise the support sleeve 825 is substantially the same as the support sleeve 125 of the first embodiment. The support sleeve 825 may be termed "castellated" because of the shape of the fingers 810 and gaps 815, and the fingers and gaps may be termed "castellations" or "castle grooves."

The purpose of the fingers 810 and gaps 815 is to weaken the lower portion of the support sleeve or reduce its rigidity. In this regard, the support sleeve 825 may be said to have a portion of first rigidity (the upper portion) and a portion of second rigidity (the lower portion) that has lower rigidity or is less rigid than the portion of first rigidity. The portion of second rigidity is preferably still more rigid than the exhaust tube 820. Reducing the rigidity of the lower portion of the sleeve may facilitate insertion of the foot valve assembly 800 into the counter bore 6*e*, where the friction and interference fit between the exhaust tube 820 and the counter bore 6*e* becomes too great and causes undesired premature yielding of the exhaust tube 820, or results in the foot valve assembly 800 becoming stuck in the counter bore 6*e* before the foot valve assembly 800 is fully inserted. The castellations permit the lower portion of the support sleeve to deflect or even yield to reduce the interference fit and friction between the lower portion of the exhaust tube 820 and the counter bore 6*e*.

In other embodiments, the lower portion of the support sleeve may be weakened or made less rigid to achieve a similar result to the above-identified castellations by providing a plurality of holes or other rigidity-reducing features in the lower portion of the support sleeve. Such holes may have the additional functionality of facilitating removal of the support sleeve 825 from the exhaust tube 820 with a hook or the like.

Figure 10:
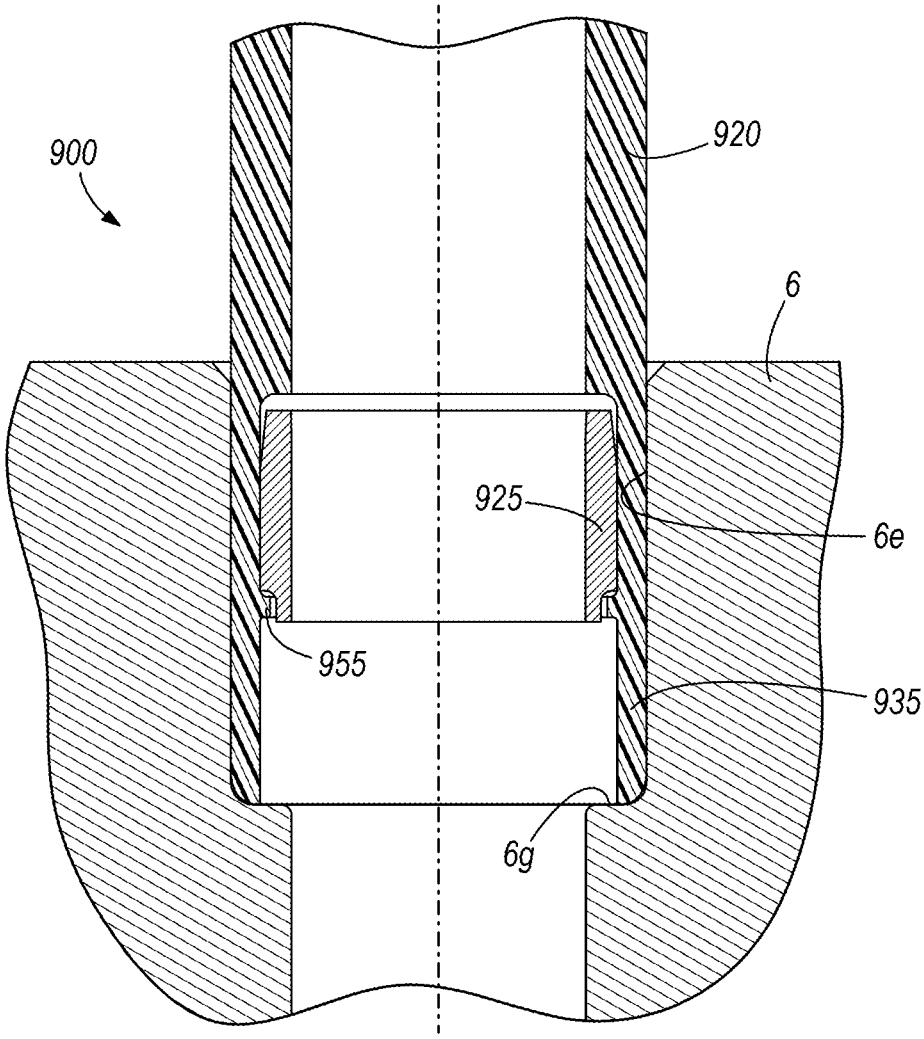
FIG. 10 is a cross-section view of a ninth embodiment of the foot valve assembly installed in the counter bore.

FIG. 10 illustrates a ninth embodiment of the foot valve assembly 900, which includes an exhaust tube 920 having first and second opposite ends, and a support sleeve 925 having first and second opposite ends. The exhaust tube 920 is substantially the same as the exhaust tube 120 of the first embodiment, except that the retaining rim 955 is raised up into the lower portion 935 of the exhaust tube 920. The retaining rim 955 may be positioned, for example, halfway up in the lower portion 935. The retaining rim 955 is integrally formed in the wall of the lower portion 935 and extends inwardly from the inner surface. The support sleeve 925 is substantially identical to the support sleeve 125 of the first embodiment except that it is shorter so that it only occupies the upper part the lower portion 935. Consequently, neither of the first and second opposite ends of the support sleeve is adjacent either of the first and second opposite ends of the cylindrical member.

As with the eighth embodiment, this embodiment addresses the potential occurrence of the exhaust tube 920 becoming stuck only partially inserted into the counter bore 6*e* due to high frictional engagement of the lower portion of the exhaust tube 920 in the counter bore 6*e*. This embodiment does not resist yielding of the exhaust tube 920 below the support sleeve 925. If the foot valve assembly 900 meets significant frictional resistance during insertion of the foot valve 900 into the counter bore 6*e*, the lower portion of the exhaust tube 920 can yield to permit continued insertion of the foot valve assembly 900. The support sleeve 925 will resist deformation of the exhaust tube wall between the support sleeve and the counter bore 6*e* once the foot valve assembly 900 is fully inserted.

Thus, the invention provides, among other things, a method and apparatus for securing a cylindrical member in a bore in a component of a DTH drill. Various features and advantages of the invention are set forth in the following claims.

What is claimed is:

1. A foot valve assembly for a down-the-hole ("DTH") drill that includes a drill bit including a bit bore having a bit bore diameter, the assembly comprising:

a cylindrical member having a cylindrical member outer diameter larger than the bit bore diameter and including a cylindrical member bore defining a cylindrical member inner diameter, the cylindrical member having a cylindrical member rigidity; and a support sleeve having an outer sleeve diameter less than the cylindrical member inner diameter and inserted into the cylindrical member bore to form a cylindrical member and sleeve assembly, at least a portion of the support sleeve having a rigidity greater than the cylindrical member rigidity;

wherein the cylindrical member and sleeve assembly is inserted into the bit bore, which causes the cylindrical member to deform such that the outer diameter of the cylindrical member can fit within the bit bore and such that the cylindrical member deforms against the support sleeve to fit within the bit bore, such that the cylindrical member is fixedly sandwiched between the support sleeve and the bit bore; and wherein the cylindrical member and support sleeve assembly includes a gap between the support sleeve and the cylindrical member bore prior to insertion of the cylindrical member and support sleeve assembly into the bit bore; and wherein deformation of the cylindrical member during insertion into the bit bore closes the gap and causes the cylindrical member to apply pressure to the support sleeve.

2. The assembly of claim 1, wherein the cylindrical member includes a retaining rim; wherein the retaining rim defines an opening having a smaller diameter than the outer sleeve diameter, such that upon insertion of the support sleeve into the cylindrical member bore, the retaining rim engages a portion of the support sleeve to resist removal of the support sleeve from the cylindrical member bore.

3. The assembly of claim 2, wherein the support sleeve includes a beveled surface to facilitate insertion of the support sleeve through the opening defined by the retaining rim.

4. The assembly of claim 2, wherein the support sleeve includes a cut-out that mates with the retaining rim upon insertion of the support sleeve into the cylindrical member bore.

5. The assembly of claim 2, wherein the retaining rim is included in an end of the cylindrical member; and wherein an end of the support sleeve is engaged by the retaining rim to maintain an end of the support sleeve adjacent the end of the cylindrical member.

6. The assembly of claim 2, wherein the cylindrical member includes first and second opposite ends and the support sleeve includes first and second opposite ends; and wherein the retaining rim is positioned within the cylindrical member bore such that neither of the first and second opposite ends of the support sleeve is adjacent either of the first and second opposite ends of the cylindrical member.

7. The assembly of claim 1, wherein a wall of at least one of the cylindrical member and support sleeve is tapered.

8. The assembly of claim 1, wherein the bit bore includes a shoulder against which both the cylindrical member and support sleeve abut upon insertion of the cylindrical member and support sleeve assembly into the bit bore.

9. The assembly of claim 1, wherein the support sleeve includes a longitudinally-extending slit defined by longitudinally-extending free ends; and wherein deformation of the cylindrical member upon insertion of the cylindrical member and support sleeve assembly into the bit bore applies pressure on the support sleeve sufficient to bring the free ends into contact and close the longitudinally-extending slit; and wherein contact of the free ends enables the support sleeve to resist additional pressure applied by the cylindrical member on the support sleeve such that additional deformation of the cylindrical member occurs after the free ends have come into contact.

10. The assembly of claim 1, wherein the support sleeve defines a non-circular cross-section and the cylindrical bore defines a circular cross-section; and wherein upon insertion of the cylindrical member and support sleeve assembly into the bit bore the support sleeve is forced into a circular cross-section under pressure applied by the cylindrical member.

11. The assembly of claim 10, wherein the non-circular cross-section of the support sleeve defines an oval having a major axis and a minor axis; wherein the support sleeve contacts a surface of the cylindrical member bore at the major axis of the support sleeve upon insertion of the support sleeve into the cylindrical member bore; and wherein contact of the support sleeve and surface of the cylindrical member bore creates an interference fit between the support sleeve and the surface of the cylindrical member bore sufficient to resist removal of the support sleeve from the cylindrical member and sleeve assembly.

12. The assembly of claim 1, wherein the support sleeve includes a portion of first rigidity and a portion of second rigidity lower than the first rigidity; wherein the portion of second rigidity deforms during insertion of the cylindrical member and sleeve assembly into the bit bore; and wherein the cylindrical member is fixedly sandwiched between the portion of first rigidity and the bit bore.

13. The assembly of claim 12, wherein the portion of second rigidity includes rigidity-reducing features.

14. The assembly of claim 12, wherein the portion of second rigidity includes at least one of a slit, a hole, and castellations.

15. A foot valve assembly for a down-the-hole ("DTH") drill that includes a drill bit including a bit bore having a bit bore diameter, the assembly comprising:

a cylindrical member having a cylindrical member outer diameter larger than the bit bore diameter and including a cylindrical member bore defining a cylindrical member inner diameter, the cylindrical member having a cylindrical member rigidity; and a support sleeve having an outer sleeve diameter less than the cylindrical member inner diameter and inserted into the cylindrical member bore to form a cylindrical member and sleeve assembly, at least a portion of the support sleeve having a rigidity greater than the cylindrical member rigidity;

wherein the cylindrical member and sleeve assembly is inserted into the bit bore, which causes the cylindrical member to deform such that the outer diameter of the cylindrical member can fit within the bit bore and such that the cylindrical member deforms against the support sleeve to fit within the bit bore, such that the cylindrical member is fixedly sandwiched between the support sleeve and the bit bore; and wherein the cylindrical member includes an exhaust tube; wherein the cylindrical member bore includes a through bore in the exhaust tube; and wherein the cylindrical member and support sleeve assembly defines a foot valve assembly for the DTH drill, the foot valve assembly being adapted to be alternatingly placed into and out of communication with at least one chamber of the DTH drill for the flow of motive fluid through the exhaust tube through bore.

16. A foot valve assembly for a down-the-hole ("DTH") drill that includes a drill bit including a bit bore having a bit bore diameter, the assembly comprising:

a cylindrical member having a cylindrical member outer diameter larger than the bit bore diameter and including a cylindrical member bore defining a cylindrical member inner diameter, the cylindrical member having a cylindrical member rigidity; and a support sleeve having an outer sleeve diameter less than the cylindrical member inner diameter and inserted into the cylindrical member bore to form a cylindrical member and sleeve assembly, at least a portion of the support sleeve having a rigidity greater than the cylindrical member rigidity;

wherein the cylindrical member and sleeve assembly is inserted into the bit bore, which causes the cylindrical member to deform such that the outer diameter of the cylindrical member can fit within the bit bore and such that the cylindrical member deforms against the support sleeve to fit within the bit bore, such that the cylindrical member is fixedly sandwiched between the support sleeve and the bit bore; and wherein the cylindrical member bore extends through the cylindrical member from a first end of the cylindrical member to a second end opposite the first end; wherein the cylindrical member bore includes a smaller diameter portion between the first end and a transition point, and a larger diameter portion between the transition point and the second end; and wherein the support sleeve is inserted into the larger diameter portion of the cylindrical member bore to form the cylindrical member and sleeve assembly.

17. A method for inserting a foot valve into a bit bore of a drill bit in a down-the-hole ("DTH") drill, the bit bore having a bit bore diameter, the method comprising:

(a) providing a cylindrical member including a cylindrical member bore and having a cylindrical member rigidity;

(b) providing a support sleeve having an outer surface, at least a portion of the support sleeve having a rigidity greater than the cylindrical member rigidity, the cylindrical member and support sleeve together defining the foot valve; and (c) deforming the cylindrical member against the bit bore and the outer surface of the support sleeve, as a result of inserting the cylindrical member and support sleeve into the bit bore, to fixedly sandwich the cylindrical member between the support sleeve and the bit bore;

further comprising a step of (b') inserting the support sleeve into the cylindrical member bore prior to the step (c) to define a cylindrical member and sleeve assembly; and wherein the step (c) includes inserting the cylindrical member and sleeve assembly into the bit bore; wherein the step (b') includes defining a gap between the outer surface of the support sleeve and the cylindrical member bore; and wherein the step (c) includes deforming the cylindrical member to close the gap and apply pressure to the support sleeve.

18. The method of claim 17, wherein the step (a) includes providing a retaining rim in the cylindrical member, the retaining rim defining an opening of smaller diameter than an outer diameter of at least a portion of the outer surface of the support sleeve; and wherein the step (b') includes resisting removal of the support sleeve from the cylindrical member bore with the retaining rim.

19. The method of claim 18, wherein the step (b) includes providing a cut-out in the support sleeve; and wherein resisting removal of the support sleeve from the cylindrical member bore includes engaging the cut-out of the support sleeve with the retaining rim.

20. The method of claim 18, wherein providing a retaining rim includes positioning the retaining rim in an end of the cylindrical member; and wherein resisting removal of the support sleeve includes maintaining an end of the support sleeve adjacent the end of the cylindrical member.

21. The method of claim 18, wherein the step (a) includes providing a cylindrical member having first and second opposite ends; wherein the step (b) includes providing a support sleeve having first and second opposite ends; and wherein resisting removal of the support sleeve includes maintaining neither of the first and second opposite ends of the support sleeve adjacent either of the first and second opposite ends of the cylindrical member.

22. The method of claim 17, wherein at least one of the steps (a) and (b) includes providing a tapered surface in at least one of the cylindrical member and support sleeve.

23. The method of claim 17, wherein the bit bore defines a shoulder at its bottom; and wherein the step (c) includes abutting at least one of the cylindrical member and support sleeve against the shoulder in the bit bore.

24. The method of claim 17, wherein the step (b) includes providing a longitudinally-extending slit defined by longitudinally-extending free ends in the support sleeve; wherein the step (c) includes deforming the cylindrical member to apply pressure on the support sleeve sufficient to bring the free ends into contact and close the longitudinally-extending slit; and wherein the step (c) further includes continuing deformation of the cylindrical member against the support sleeve after the free ends are in contact.

25. The method of claim 17, wherein the step (b) includes providing a support sleeve that includes a portion of first rigidity and a portion of second rigidity lower than the first rigidity; wherein the step (c) includes deforming the portion of second rigidity and fixedly sandwiching the cylindrical member between the portion of first rigidity and the bit bore.

26. The method of claim 25, wherein the step (b) further includes providing the portion of second rigidity with rigidity-reducing features in the support sleeve.

27. The method of claim 25, wherein the step (b) further includes providing at least one of slots, holes, and castellations in the portion of second rigidity.

28. The method of claim 17, wherein the step (a) includes providing a cylindrical member having a generally cylindrical portion, and defining in the cylindrical member bore a smaller diameter portion; wherein the step (b) includes providing a larger diameter portion of the outer surface of the support sleeve, the larger diameter portion having a diameter larger than the smaller diameter portion; wherein the step (c) includes inserting the support sleeve into the bit bore to define a gap between at least a portion of the support sleeve outer surface and the bit bore, inserting the generally cylindrical portion into the gap, and deforming the generally cylindrical portion upon the smaller diameter portion of the cylindrical member bore being forced over the larger diameter portion of the support sleeve.

29. The method of claim 28, wherein the bit bore is tapered; wherein the step (a) includes providing tapered inner and outer surfaces of the generally cylindrical portion; and wherein the step (b) includes providing a tapered outer surface of the support sleeve.

* * * * *